US011111716B2

(12) United States Patent
Beeler et al.

(10) Patent No.: US 11,111,716 B2
(45) **Date of Patent: *Sep. 7, 2021**

(54) ANTI-FLOAT SYSTEMS AND METHODS

(71) Applicant: MODERNFOLD, INC., Greenfield, IN (US)

(72) Inventors: Michael W. Beeler, Anderson, IN (US); Mark A. Johnson, Fortville, IN (US); Bradley A. Jones, Anderson, IN (US); Thomas L. Goldsmith, Earlville, IA (US)

(73) Assignee: Modernfold, Inc., Greenfield, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/875,183

(22) Filed: May 15, 2020

(65) Prior Publication Data

US 2020/0277819 A1 Sep. 3, 2020

Related U.S. Application Data

(63) Continuation of application No. 15/588,385, filed on May 5, 2017, now Pat. No. 10,669,772.

(51) Int. Cl.

| | |
|---|---|
| ***E06B 3/48*** | (2006.01) |
| ***E05D 15/26*** | (2006.01) |
| ***E05F 1/16*** | (2006.01) |
| ***E05F 3/22*** | (2006.01) |

(52) U.S. Cl.

CPC ..... *E06B 3/481* (2013.01); *E05D 15/26* (2013.01); *E05F 1/16* (2013.01); *E05F 3/22* (2013.01); *E05F 3/224* (2013.01); *E05D 2015/268* (2013.01); *E05Y 2900/142* (2013.01)

(58) Field of Classification Search

CPC ..... E06B 3/481; E06B 3/485; E06B 3/486; E06B 3/487; E05D 15/06; E05D 15/0621; E05D 15/26; E05D 2015/268; E05F 1/16; E05F 3/22; E05F 3/224; E05F 15/51; E05Y 2900/142

See application file for complete search history.

(56) References Cited

U.S. PATENT DOCUMENTS

| | | | |
|---|---|---|---|
| 1,757,075 | A | 5/1930 | Earhart |
| 2,286,344 | A | 6/1942 | Chechot |
| 3,116,782 | A | 1/1964 | Rudnick |

(Continued)

FOREIGN PATENT DOCUMENTS

| | | |
|---|---|---|
| CA | 2966760 A1 | 11/2018 |
| EP | 3260638 A1 | 12/2017 |

OTHER PUBLICATIONS

Anti-Float System—Modernfold, publicly disclosed at least by May 4, 2016, 3 pages.

(Continued)

*Primary Examiner* — Beth A Stephan

(74) *Attorney, Agent, or Firm* — Faegre Drinker Biddle & Reath LLP

(57) ABSTRACT

A movable wall system includes a plurality of movable wall panels including a first movable wall panel and a second moveable wall panel rotatably coupled together through at least one hinge. The movable wall system further includes a biasing system which biases the first movable wall panel and the second movable wall panel into an arrangement wherein a panel face of the first movable wall panel and a panel face of the second moveable wall panel are generally parallel.

22 Claims, 19 Drawing Sheets

(56) References Cited

U.S. PATENT DOCUMENTS

| | | | |
|---|---|---|---|
| 3,310,913 | A | 3/1967 | Richter |
| 3,385,344 | A | 5/1968 | Andrews |
| 3,907,021 | A | 9/1975 | Smith |
| 4,284,118 | A | 8/1981 | Ceron |
| 4,387,760 | A | 6/1983 | Greschbach |
| 4,731,904 | A | 3/1988 | Sprague |
| 5,070,926 | A | 12/1991 | Behring |
| 5,096,433 | A | 3/1992 | Boundy |
| 5,152,332 | A | 10/1992 | Siener |
| 5,499,671 | A | 3/1996 | Owens |
| 5,551,499 | A | 9/1996 | McRoberts |
| 6,257,304 | B1 | 7/2001 | Jacobs et al. |
| 6,393,772 | B1 | 5/2002 | McRoberts et al. |
| 6,460,221 | B1 | 10/2002 | Eromaeki |
| 6,571,855 | B1 | 6/2003 | Goldsmith et al. |
| 6,598,355 | B2 | 7/2003 | Owens |
| 6,698,491 | B2 | 3/2004 | Goldsmith et al. |
| 6,715,530 | B2 | 4/2004 | Goldsmith et al. |
| 6,823,927 | B2 | 11/2004 | Steel et al. |
| 7,255,045 | B2 | 8/2007 | Owens |
| 8,096,341 | B2 | 1/2012 | Teunissen |
| 9,140,055 | B2 | 9/2015 | Skibinski et al. |
| 10,577,853 | B2 | 3/2020 | Jones et al. |
| 2003/0183350 | A1 | 10/2003 | Goldsmith et al. |
| 2010/0190369 | A1 | 7/2010 | Byrne |
| 2012/0083147 | A1 | 4/2012 | Welch et al. |
| 2014/0059933 | A1 | 3/2014 | Jones et al. |
| 2017/0044811 | A1 | 2/2017 | Tsou et al. |
| 2017/0067280 | A1 | 3/2017 | Thomas |
| 2018/0320432 | A1 | 11/2018 | Beeler et al. |

OTHER PUBLICATIONS

BCY DynaFLIGHT 97 Bow String Material, http//www.3riversarchery.com/bcy-dynaflight-97-bow-string-material-d97-string-material . . . , accessed May 4, 2017, 3 pages.

ANTI-FLOAT SYSTEMS AND METHODS

CROSS-REFERENCE TO RELATED APPLICATIONS

This application is a continuation of U.S. application Ser. No. 15/588,385, filed on May 5, 2017, titled "ANTI-FLOAT SYSTEMS AND METHODS", the entire contents of which is incorporated herein by reference.

BACKGROUND AND SUMMARY

This disclosure relates alignment systems for movable wall systems operable to partition a large environment, such as rooms, into a plurality of smaller environments. More particularly, the present disclosure relates to a movable wall panel system having a plurality of panels moveable between an extended configuration and a retracted configuration and an alignment system which biases the plurality of panels such that a panel face of a first movable wall panel of the plurality of movable wall panels is substantially parallel to a panel face of a second movable wall panel of the plurality of movable wall panels.

Movable wall panel systems find useful applications in a variety of venues such as classrooms, offices, convention facilities, hospitals or the like. In these venues, the panels of the moveable wall panel system are often moved along overhead tracks from which the panels are suspended. The partitions are movable along the tracks to separate or compartmentalize larger rooms or areas into smaller rooms or areas. The operable partitions are typically connected to trolleys that roll within the overhead track. The track is suspended from a support structure which is typically located above the ceiling of a room or area in which the operable partitions are installed.

Operable partitions are typically available in single panel, paired panel, and continuously hinged arrangements. Continuously hinged panels are connected together in a train so that the panels extend as one complete unit. A drive system is connected to a trolley of a lead panel to move the train of panels.

An anti-float system is known to assist in biasing the movable wall panels of a continuously hinged panel system into one or both of a retracted or stacked configuration and an extended configuration. An exemplary anti-float system is described in U.S. Pat. No. 5,499,671. Another conventional anti-float system is shown in FIGS. 1-4. Referring to FIG. 1, a first movable wall panel 10 is shown. Referring to FIG. 3, a second movable wall panel 12 is shown. Wall panels 10, 12 are connected together through a hinge 14. Referring to FIG. 2, wall panel 10 includes a front panel face 20 and a rear panel face 22. An upper extent of front panel face 20 is noted by reference number 24. A plurality of seals 26 extend above the upper portion of movable wall panel 10 as shown in FIG. 2. In a similar fashion, movable wall panel 12 includes a front face 30 and a rear face 32. An upper vertical extent of front face 30 is indicated by reference number 34. Located above an upper extent of movable wall panel 12 are a plurality of seals 36.

In between seals 26 of movable wall panel 10 and seals 36 of movable wall panel 12, an anti-float system 50 is coupled to a top side of movable wall panels 10 and 12, respectively. Movable wall panel 10 supports a first bracket 52 and a second bracket 54. Each of first bracket 52 and second bracket 54 include a plurality of rollers 56 which guide respective wire cables 58. The wire cables 58 have a first loop 60 which is coupled to a spring 62 and a second loop

64 which are coupled to an anchor 66 on adjacent panels, such as movable wall panel 12. Wire 58 passes over roller 56 mounted on a bracket 70 supported by the second movable wall panel 12. When movable wall panels 10 and 12 are angled relative to each other about hinge 14, spring 62 is stretched. As movable wall panels 10, 12 approach being parallel to each other such that panel face 22 is generally co-planar with panel face 30, spring 62 pulls on cable 58 to bias wall panels 10, 12 into a generally co-planar relationship. In a similar fashion, as wall panels 10, 12 move toward a stacked configuration, the placement of rollers 56 may be chosen such that spring 62 will bias panels 10, 12 to move toward a generally parallel configuration wherein panels 10, 12 are stacked.

The placement of anti-float system 50 between seals 26 on movable wall panel 10 and between seals 36 on movable wall panel 12 makes installation and maintenance of anti-float system 50 difficult. In order to install or service an anti-float system 50, an operator must be positioned to access the region between seals 26 on movable wall panel 10 and between seals 36 on movable wall panel 12 which are near the overhead track.

In an exemplary embodiment of the present disclosure, a movable wall panel system for suspension from an overhead track in an environment is provided. The movable wall panel system comprising a first movable wall panel including a first end and a second end, spaced-apart from the first end, a panel face extending between the first end and the second end, a top portion which is adapted to be operatively coupled to the overhead track, and a bottom portion opposite the top portion. The panel face of the first movable wall panel having a vertical extent extending from a bottom side of the panel face of the first movable wall panel to a top side of the panel face of the first movable wall panel. The movable wall panel system further comprising a second movable wall panel rotatably coupled to the first moveable wall panel, the second moveable wall panel including a first end and a second end, spaced-apart from the first end, a panel face of the second movable wall panel extending between the first end and the second end, a top portion which is adapted to be operatively coupled to the overhead track, and a bottom portion opposite the top portion. The panel face of the second movable wall panel having a vertical extent extending from a bottom side of the panel face of the second movable wall panel to a top side of the panel face of the second movable wall panel. The movable wall panel system further comprising at least one hinge coupled to the first movable wall panel proximate the second end of the first movable wall panel and coupled to the second movable wall panel proximate the first end of the second movable wall plane. The first movable wall panel being rotatably coupled to the second movable wall panel through the at least one hinge. The movable wall panel system further comprising a biasing system operatively coupled to the first moveable wall panel and operatively coupled to the second moveable wall panel independent of the at least one hinge. The biasing system biasing the second moveable wall panel to be positioned relative to the first movable wall panel such that the panel face of the first moveable wall panel is substantially parallel to the panel face of the second moveable wall panel. The biasing system being positioned above the bottom side of the panel face and below the top side of the panel face.

In an example thereof, the biasing system includes a primary biasing sub-assembly positioned within an interior of the first movable wall panel and a secondary biasing sub-assembly positioned within an interior of the second movable wall panel, the secondary biasing sub-assembly being connected to the primary biasing sub-assembly through a link extending between the second end of the first movable wall panel and the first end of the second movable wall panel. In a variation thereof, the link extends through an opening in the second end of the first movable wall panel and through an opening in the first end of the second movable wall panel. In a further variation thereof, the secondary biasing sub-assembly of the biasing system is connected to the primary biasing sub-assembly of the biasing system through the link throughout a movement of the first movable wall panel and the second movable wall panel from a first arrangement wherein the panel face of the first movable wall panel and the panel face of the second movable wall panel are generally parallel and overlapping and a second arrangement wherein the panel face of the first movable wall panel and the panel face of the second movable wall panel are generally parallel and non-overlapping. In yet a further variation thereof, the secondary biasing sub-assembly includes an anchor, the link being coupled to the second movable wall panel through the anchor. In still a further variation thereof, the primary biasing sub-assembly includes a biasing member positioned within a housing, the link being coupled to the first movable wall panel through the biasing member. In still another variation thereof, the biasing member has a first end held relative to the first movable wall panel and a second end movable relative to the first movable wall panel and connected to the link, the biasing member being positionable in a first state and a second state, wherein in the first state the biasing member has a first level of stored potential energy and in the second state the biasing member has a second level of potential energy, the second level of stored potential energy being less than the first level of potential energy. In another variation thereof, the first movable wall panel and the second movable wall panel are positionable in a third arrangement wherein the panel face of the first movable wall panel and the panel face of the second movable wall panel are angled relative to each other in the range of about 30 degrees to about 60 degrees, the biasing member being in the first state when the first movable wall panel and the second movable wall panel are positioned in the third arrangement and in the second state when the first movable wall panel and the second movable wall panel are positionable in the second arrangement. In still another variation thereof, the first movable wall panel and the second movable wall panel are positionable in a third arrangement wherein the panel face of the first movable wall panel and the panel face of the second movable wall panel are angled relative to each other in the range of about 30 degrees to about 60 degrees, the biasing member being in the first state when the first movable wall panel and the second movable wall panel are positioned in the third arrangement and in the second state when the first movable wall panel and the second movable wall panel are positionable in the first arrangement. In yet a further variation thereof, the primary biasing assembly further includes a lock which cooperates with the biasing member to hold the biasing member the first state. In a further variation, the biasing member is a gas cylinder. In still yet another variation, the primary biasing assembly further includes a lock which cooperates with the gas cylinder to hold the gas cylinder in the first state.

In another example thereof, the first moveable wall panel includes a top seal assembly which provides an acoustic seal between the first movable wall panel and a ceiling of the environment, the biasing system being positioned lower than the top seal assembly. In a variation thereof, the top seal assembly is movable between a first position spaced apart from the ceiling and a second position contacting the ceiling.

In yet another example thereof, the first moveable wall panel includes a bottom seal assembly which provides an acoustic seal between the first movable wall panel and a floor of the environment, the biasing system being positioned higher than the bottom seal assembly. In a variation thereof, the bottom seal assembly is movable between a first position spaced apart from the floor and a second position contacting the floor.

In still another example thereof, the link is a flexible connector. In a variation thereof, the flexible connector includes a plurality of strands. In a further variation thereof, the flexible connector comprises at least one of a metal, linen, hemp, silk, sinew, a polymer, or combinations thereof. In another variation thereof, the flexible connector comprises at least 20 strands of an ultra high molecular weight polyethylene.

In another exemplary embodiment of the present disclosure, a method of installing an anti-float system between two movable wall panels rotatably coupled together through at least one hinge is provided. The method comprising the steps of: extending a flexible connector from a first portion of the anti-float system positioned within an interior of a first movable wall panel of the two movable wall panels to a second portion of the anti-float system positioned within an interior of a second movable wall panel of the two movable wall panels, the flexible connector passing through an opening in an end face of the first movable wall panel and an opening of an end face of the second moveable wall panel; and securing the flexible connector to an anchor of the second portion of the anti-float assembly.

In one example thereof, the method further comprises the step of increasing the tension on the flexible connector. In a variation thereof, the step of increasing the tension on the flexible connector includes the step of releasing a lock holding a biasing member in a first state to permit the biasing member to move to a second state, the biasing member being operatively coupled to the flexible connector. In another variation thereof, the biasing member is positioned within a housing having a first end and a second end, the biasing member having a first end and a second end, when the biasing member is in the first state the second end of the biasing member is spaced apart from the first end of the housing by a first amount and when the biasing member is in the second state the second end of the biasing member is spaced apart from the first end of the housing by a second amount, the second amount being greater than the first amount.

In a further exemplary embodiment of the present disclosure, a method of operating a movable wall system including a first movable wall panel and a second moveable wall panel rotatably coupled together through at least one hinge and including a biasing system which biases the first movable wall panel and the second movable wall panel into an arrangement wherein a panel face of the first movable wall panel and a panel face of the second moveable wall panel are generally parallel is provided. The method comprising the steps of extending a flexible connector from an interior of the first movable wall panel as one of the first movable wall panel and the second movable wall panel is rotated relative to the other of the first movable wall panel and the second movable wall panel about the at least one hinge, the flexible connector passing through an opening in an end face of the first movable wall panel and an opening of an end face of the second moveable wall panel; and compressing a biasing member of the biasing system due to the extending of the flexible connector.

BRIEF DESCRIPTION OF THE DRAWINGS

The detailed description particularly refers to the accompanying figures in which:

FIG. 11 illustrates the arrangement of FIG. 10 with the first movable wall panel and the second movable wall panel being rotated to form a first angle there between, FIG. 12 illustrates the arrangement of FIG. 10 with the first movable wall panel and the second movable wall panel being rotated to form a second angle there between;

FIG. 14 illustrates the arrangement of FIG. 10 with the first movable wall panel and the second movable wall panel being rotated to form a third angle there between;

Figure 1:
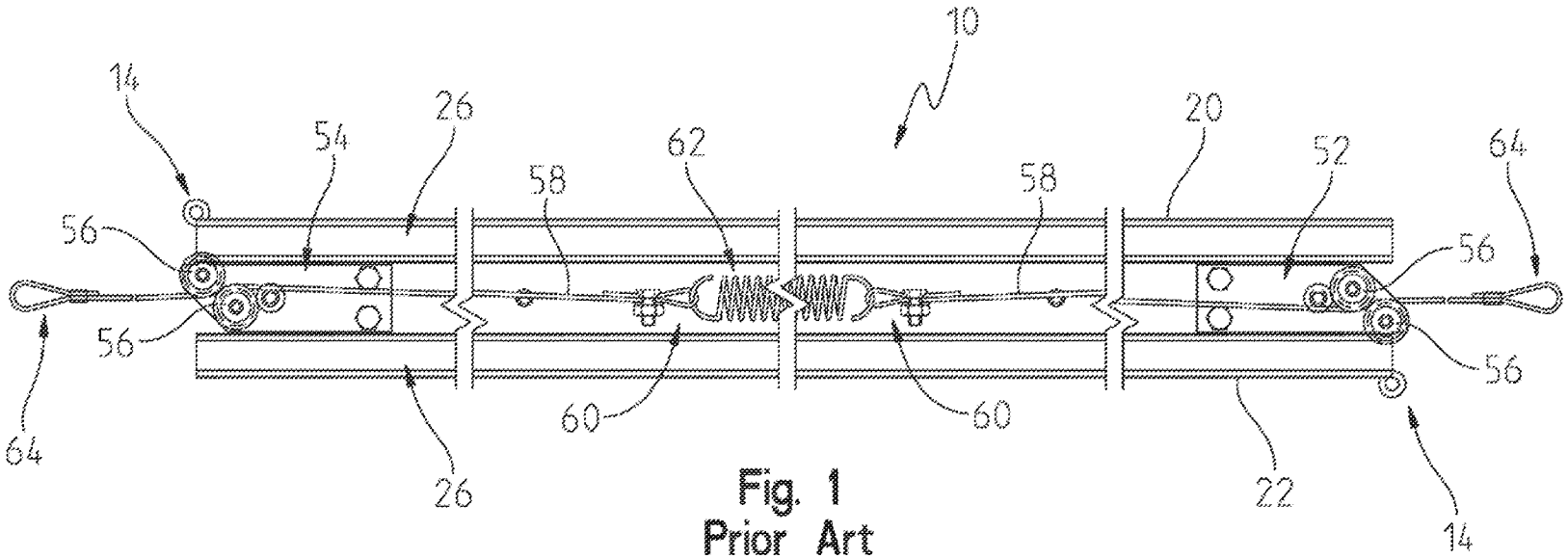
Fig. 1 Prior Art
FIGS. 1-4 illustrate a conventional anti-float system.
Figure 2:
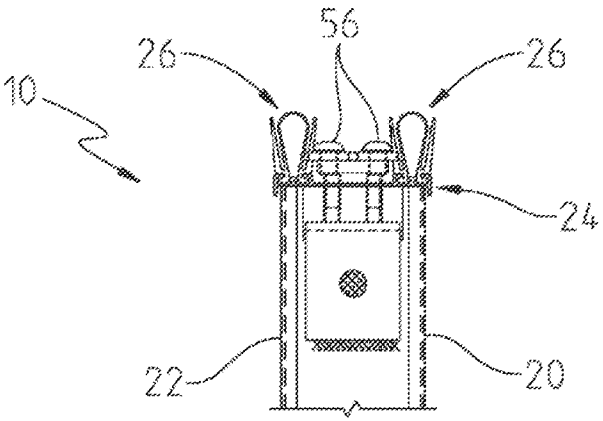
Fig. 2 Prior Art
Figure 3:
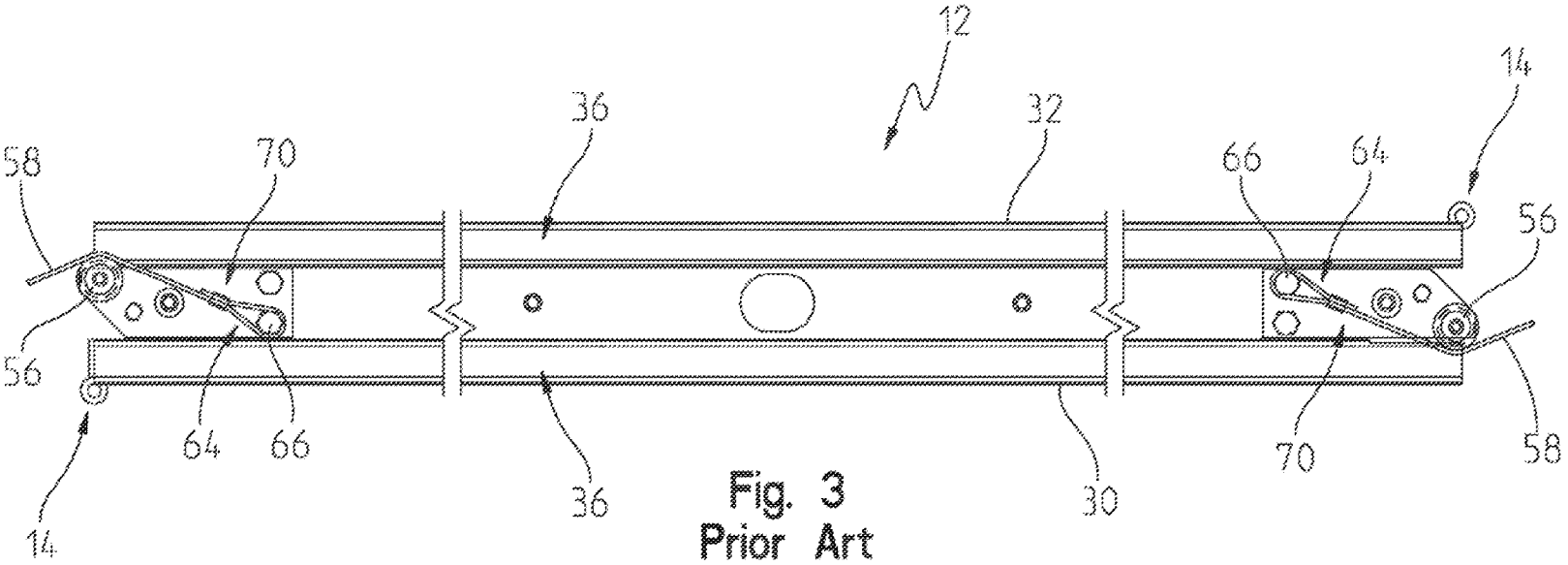
Fig. 3 Prior Art
Figure 4:
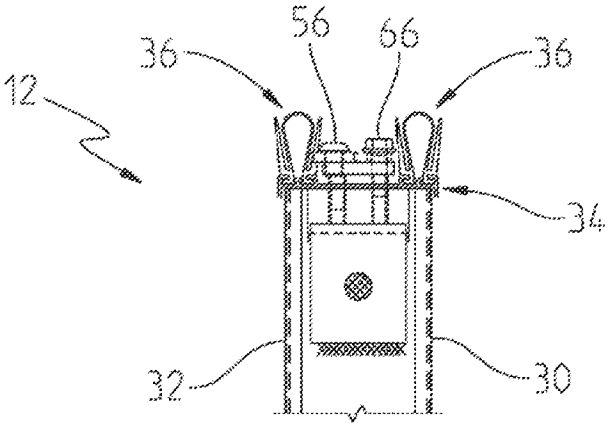
Fig. 4 Prior Art

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplification set out herein illustrates exemplary embodiments of the disclosure, in various forms, and such exemplifications are not to be construed as limiting the scope of the disclosure in any manner.

DETAILED DESCRIPTION

For the purposes of promoting an understanding of the principles of the present disclosure, reference is now made to the embodiments illustrated in the drawings, which are described below. The embodiments disclosed below are not intended to be exhaustive or limit the present disclosure to the precise form disclosed in the following detailed description. Rather, the embodiments are chosen and described so that others skilled in the art may utilize their teachings. Therefore, no limitation of the scope of the present disclosure is thereby intended. The present systems and methods include any alterations and further modifications of the illustrated devices and described methods and further applications of the principles of the present disclosure which would normally occur to one skilled in the art to which the present disclosure relates. Corresponding reference characters indicate corresponding parts throughout the several views.

The present disclosure relates to movable wall systems 100 for use in an environment 80 such as in a room 82 of a building. Referring to FIG. 1, environment 80 includes a first wall 84, a second spaced apart wall 86, a floor 88, and a ceiling (not shown).

Figure 5:
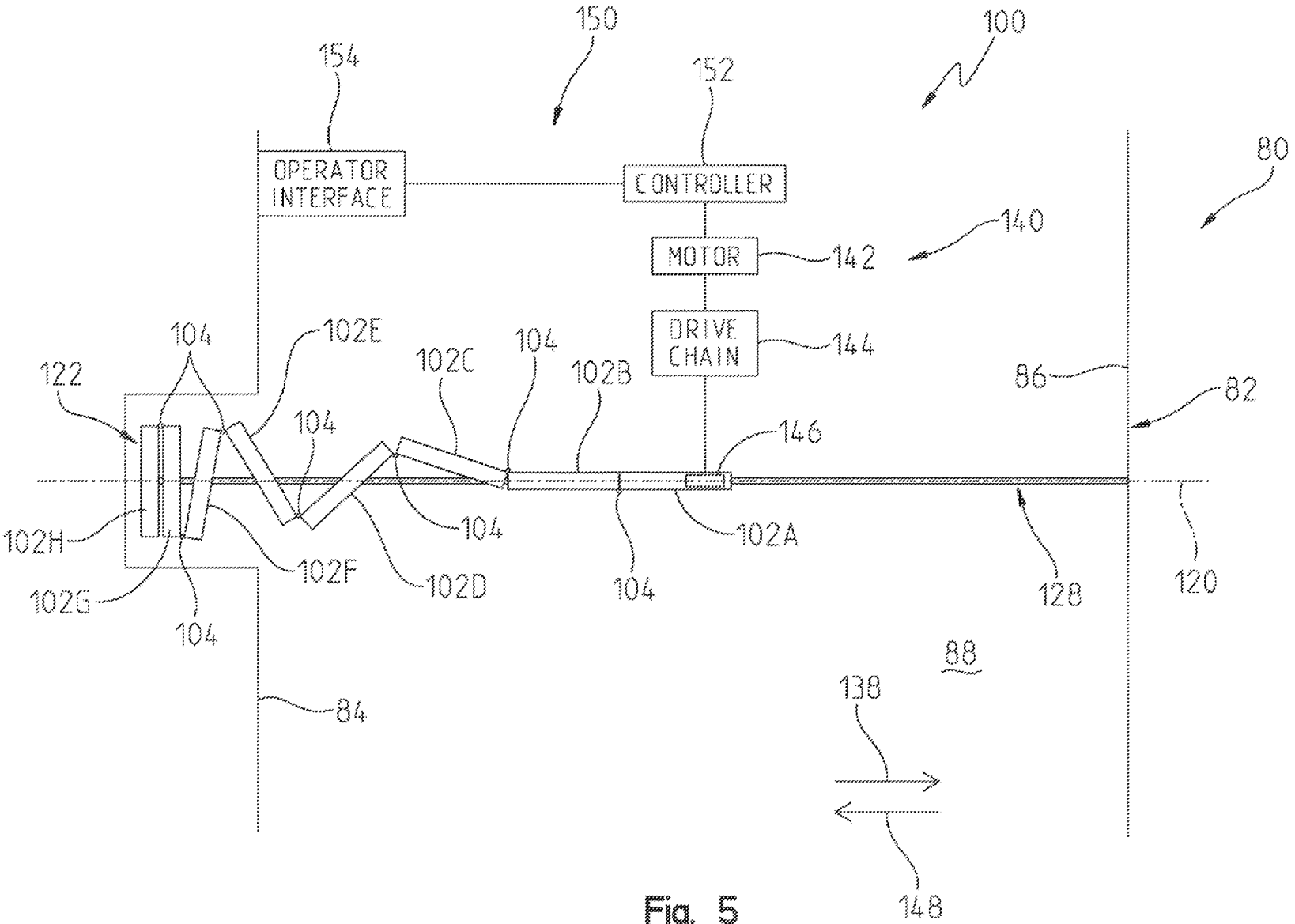
FIG. 5 illustrates an exemplary movable wall system having a plurality of exemplary movable wall panels suspended from an overhead track in an environment.
Figure 6:
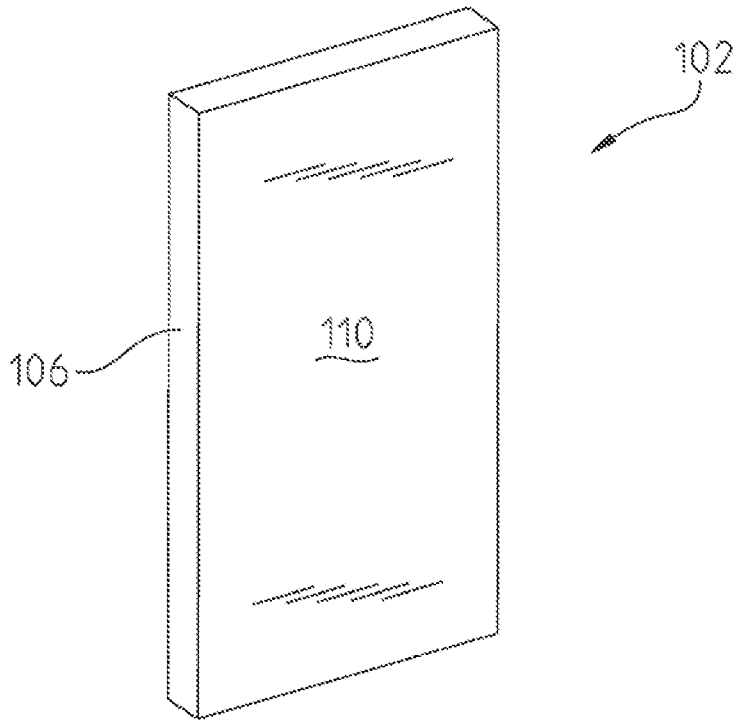
FIG. 6 illustrates a perspective view of an exemplary movable wall panel of FIG. 5.
Figure 7:
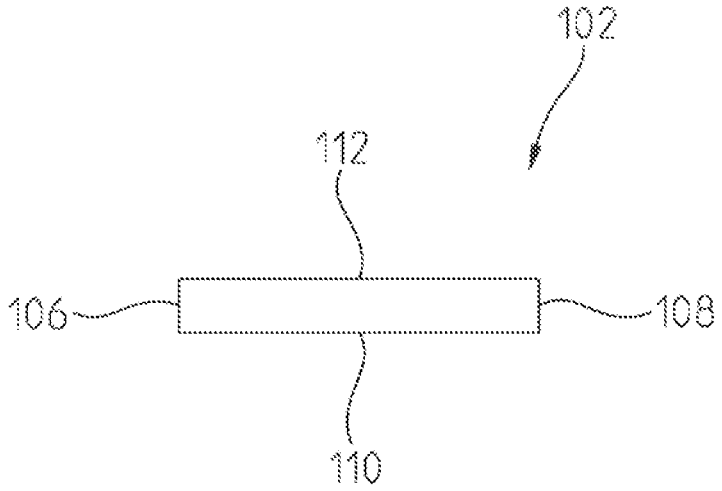
FIG. 7 illustrates a top view of the exemplary moveable wall panel of FIG. 6.

Moveable wall system 100 includes a plurality of wall panels 102, illustratively 102A-102H, rotatably coupled together at respective hinge joints 104. Referring to FIGS. 5 and 6, each wall panel 102 includes a first end 106 and a second end 108, spaced-apart from the first end 106, a first panel face 110 extending between first end 106 and second end 108, and a second panel face 112 extending between first end 106 and second end 108.

Figure 6A:
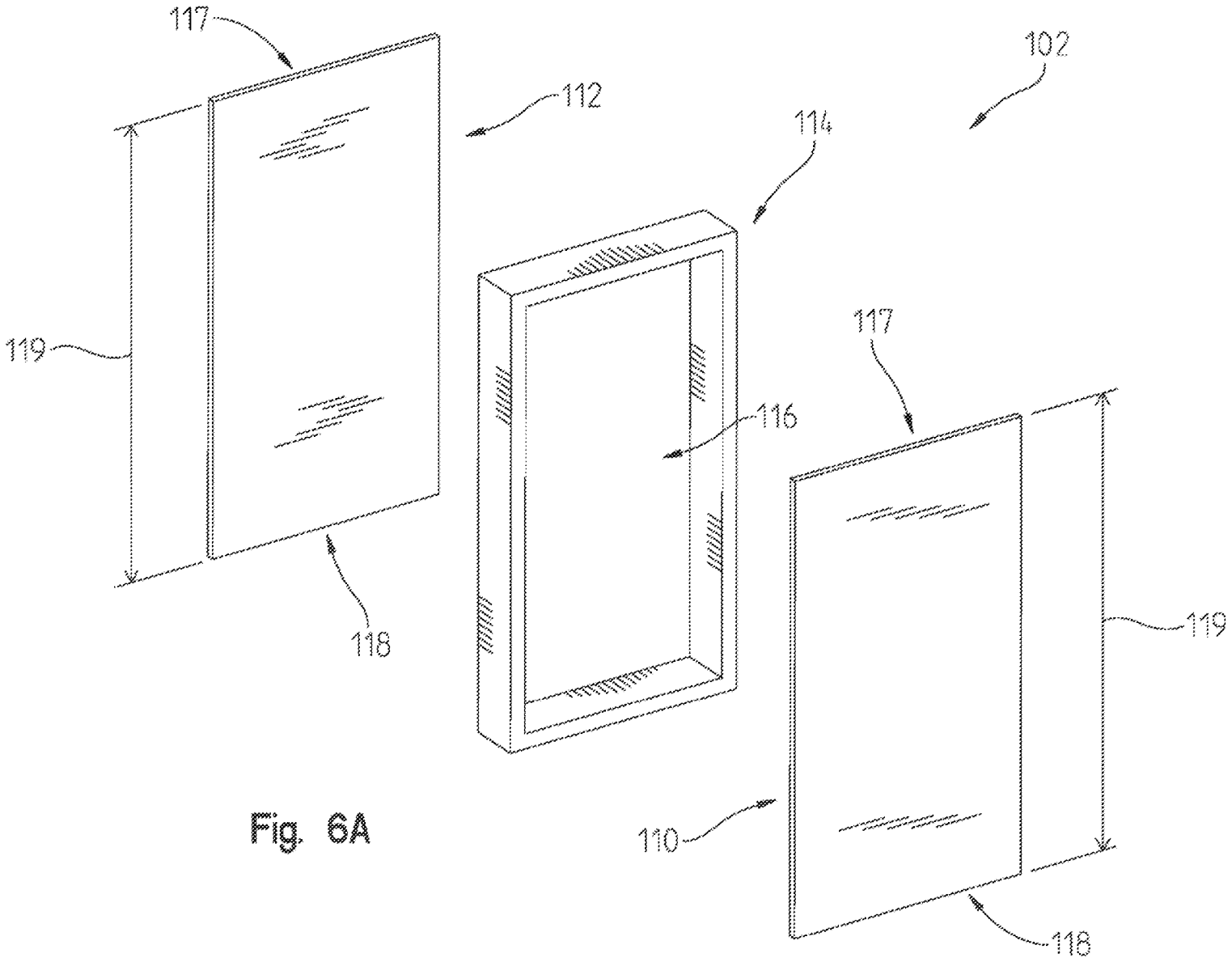
FIG. 6A illustrates an exploded perspective view of the exemplary movable wall panel of FIG. 6.

As shown in FIG. 6A, each of the plurality of wall panels include a frame 114 having an interior 116 to which each of first panel face 110 and second panel face 112 are coupled. Each panel face 110 and 112 has a top side 117 and a bottom side 118 and a vertical extent 119 there between. In one example panels 110 and 112 cover the entire vertical extent of frame 114. Panel faces 110 and 112 may be planar panels or non-planer panels. In one example, the panel faces may be fabric covered. In another example, the panel faces may have a wood finish. In a further example, the panel faces may include molding or other non-planar features.

Referring to FIG. 5, the plurality of wall panels 102 are suspended from an overhead track 128 generally positioned within a ceiling 90 (see FIG. 8) of room 82. In the illustrated embodiment, overhead track 128 intersects a vertical plane 120 along which movable wall system 100 is positioned when extended between wall 84 and wall 86. Movable wall system 100 is driven between an extended configuration and the retracted or stacked configuration through a drive system 140. Drive system 140 includes a motor 142 and a chain drive 144. Chain drive 144 is operatively coupled to a trolley support 146 coupled to lead panel 102A. Each panel includes one or more trolley supports 146 which are received in overhead track 128 and are constrained to move within overhead track 128. Motor 142 actuates chain drive 144 to either pull lead panel 102A in either direction 138 to extend movable wall system 100 or direction 148 to retract movable wall system 100.

Details regarding exemplary panels and drive systems are provided in U.S. Pat. Nos. 7,255,045; 6,715,530; 6,698,491; 6,598,355; 6,571,855; 6,393,772; 5,551,499; and 5,152,332 and in US Published Patent Application Nos. 20140059933 and 20120083147, the entire disclosures of which are expressly incorporated by reference herein.

Drive system 140 is controlled through a control system 150. Control system 150 includes a controller 152 and an operator interface 154. Details regarding exemplary control systems and monitoring systems are disclosed in U.S. patent application Ser. No. 15/586,438, filed May 4, 2017, titled SYSTEMS AND METHODS FOR CONTROLLING THE OPERATION OF A MOVABLE PANEL WALL SYSTEM, the entire disclosure of which is expressly incorporated by reference herein.

The plurality of wall panels 102 are moveable between an extended configuration wherein the panel faces 110 of the plurality of wall panels 102 are generally coplanar and parallel to plane 110 and a retracted configuration wherein the panel faces 110 of the plurality of wall panels 102 are transverse to the plane 110. In the extended configuration, panel faces 110 of movable wall panels 102 are non-overlapping and generally parallel. In the retracted configuration, panel faces 110 of movable wall panels 102 are overlapping and generally parallel. In one example, generally parallel means within about 5 degrees of being parallel.

In the illustrated embodiment, wall panels 102 extend from wall 84 to wall 86 when movable wall system 100 is in the extended position and wall panels 102 are stored in a pocket 122 in wall 84 when movable wall system 100 is in the retracted position. Exemplary panels 102 include acoustic seals between adjacent panels 102, acoustic seals between panels 102 and the ceiling of room 12, and acoustic seals between panels 102 and floor 18 of room 12. Exemplary acoustic seals are disclosed in U.S. patent application Ser. No. 13/799,248, filed Mar. 13, 2013, titled PANEL SEAL SYSTEMS, the entire disclosure of which is expressly incorporated by reference herein.

Figure 8:
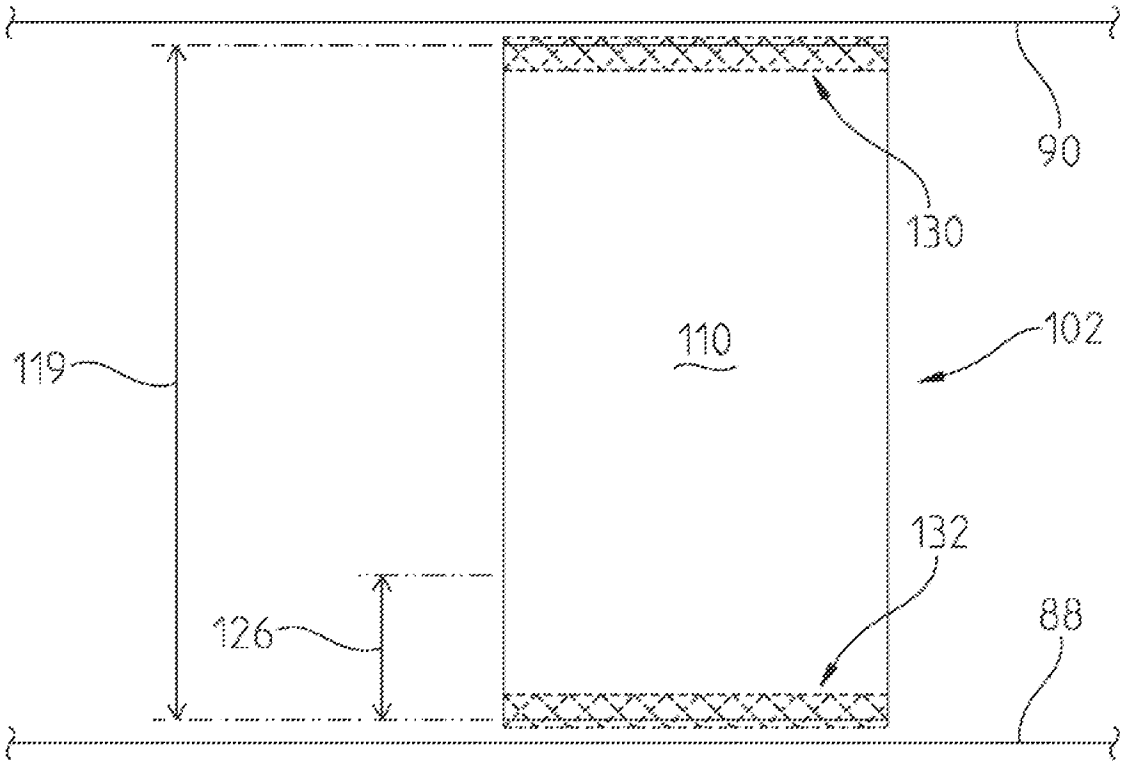
FIG. 8 illustrates the exemplary movable wall panel of FIG. 6 positioned in the environment of FIG. 5, the exemplary movable wall panel including a lower seal assembly spaced apart from the floor of the environment and an upper seal assembly spaced apart from the ceiling of the environment.
Figure 9:
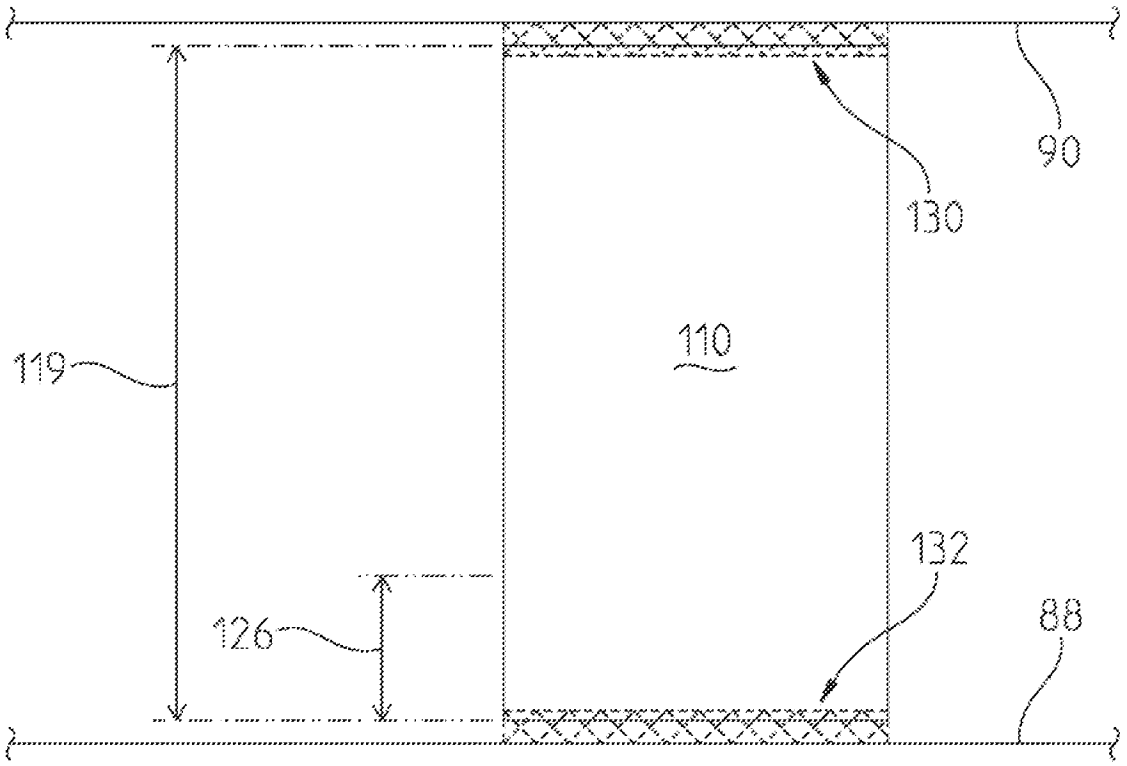
FIG. 9 illustrates the exemplary movable wall panel of FIG. 6 positioned in the environment of FIG. 5, the lower seal assembly of the exemplary movable wall panel contacting the floor of the environment and the upper seal assembly of the exemplary movable wall panel contacting the ceiling of the environment.

Referring to FIG. 8, a movable wall panel 102 is illustrated positioned between floor 88 and ceiling 90 of room 82. Wall panel 102 includes a top seal assembly 130 and a bottom seal assembly 132. As illustrated in FIG. 8, top seal assembly 130 and bottom seal assembly 132 are shown spaced apart from ceiling 90 and floor 88, respectively. Each of top seal assembly 130 and bottom seal assembly 132 carries at least one acoustic seal and is movable to a sealed configuration wherein top seal assembly 130 and bottom seal assembly 132 contact ceiling 90 and floor 88, respectively, as illustrated in FIG. 9. Exemplary top seal assemblies and bottom seal assemblies are disclosed in U.S. patent application Ser. No. 13/799,248, filed Mar. 13, 2013, titled PANEL SEAL SYSTEMS, the entire disclosure of which is expressly incorporated by reference herein.

In one embodiment, wall panels 102 are placed in environments with high ceilings. In these environments, vertical extent 119 of first panel face 110 is up to 30 feet in length. An operator space 126 having a height of about 7 feet is indicated in FIGS. 8 and 9. This is the height range in which a human operator may generally work on the wall panels 102 without the aid of a ladder or platform.

Figure 10:
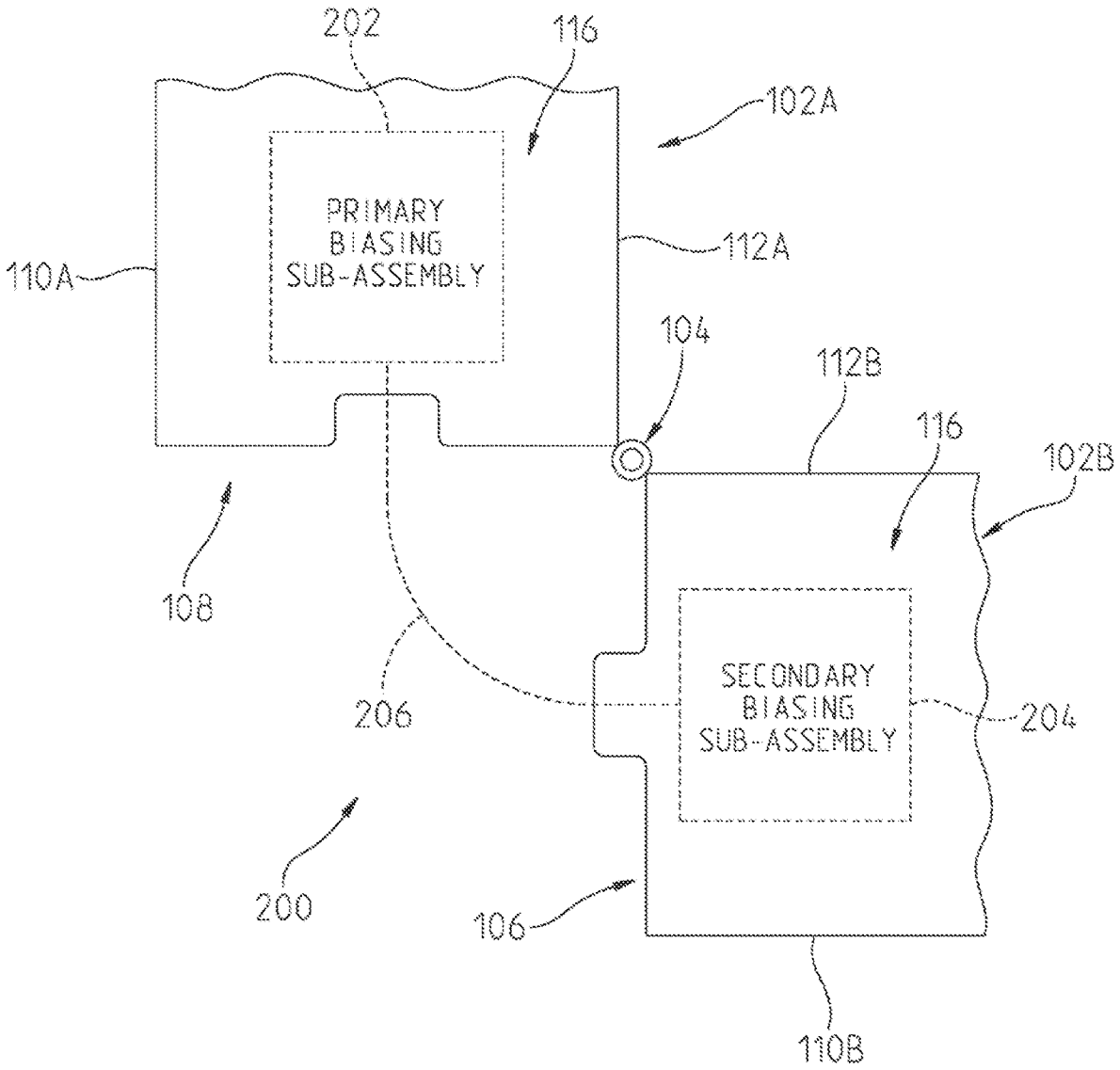
FIG. 10 illustrates an exemplary arrangement of an exemplary anti-float system connecting an exemplary first movable wall panel and an exemplary second movable wall panel, the exemplary anti-float system including a primary biasing sub-assembly supported by the first movable wall panel, a secondary biasing sub-assembly supported by the second movable wall panel, and a connecting member connecting the primary biasing sub-assembly and the secondary biasing sub-assembly.

Referring to FIG. 10, an exemplary anti-float system 200 is illustrated. Anti-float system 200 includes a biasing system having a first portion, illustratively a primary biasing sub-assembly 202, carried by first movable wall panel 102A, a second portion, illustratively a secondary biasing sub-assembly 204, carried by second moveable wall panel 102B, and a link 206 connecting primary biasing sub-assembly 202 and secondary biasing sub-assembly 204. Primary biasing sub-assembly 202 and secondary biasing sub-assembly 204 are illustratively shown positioned within the interior 116 of wall panel 102A and wall panel 102B, respectively. Alternatively, primary biasing sub-assembly 202 and secondary biasing sub-assembly 204 are positioned within the interior 116 of wall panel 102B and wall panel 102A, respectively.

Further, primary biasing sub-assembly 202 and secondary biasing sub-assembly 204 are positioned between panel faces 110 and 112 of wall panel 102A and wall panel 102B, respectively. Primary biasing sub-assembly 202 and secondary biasing sub-assembly 204 may be positioned within interior 116 of the respective wall panel 102A and 102B at any height along vertical extent 119 of the respective panel face 110. In one embodiment, primary biasing sub-assembly 202 and secondary biasing sub-assembly 204 are positioned above the bottom side 118 of the respective panel face 110 and below the top side 117 of the respective panel face 110. Primary biasing sub-assembly 202 and secondary biasing sub-assembly 204 are supported by frame 114 of the respective wall panel 102.

Link 206 couples moveable wall panel 102A to moveable wall panel 102B independent of hinge joints 104. Link 206, in one embodiment, extends through an opening in second end 108 of movable wall panel 102A and through an opening in first end 106 of movable wall panel 102B. Link 206 connects primary biasing sub-assembly 202 to secondary biasing sub-assembly 204 throughout a movement of movable wall panel 102A and movable wall panel 102B from a first arrangement 210 (see FIG. 13) wherein panel face 110A of movable wall panel 102A and panel face 110B of movable wall panel 102B are generally parallel and overlapping and a second arrangement 212 (see FIG. 15) wherein panel face 110A of movable wall panel 102A and panel face 110B of movable wall panel 102B are generally parallel and non-overlapping.

Figure 11:
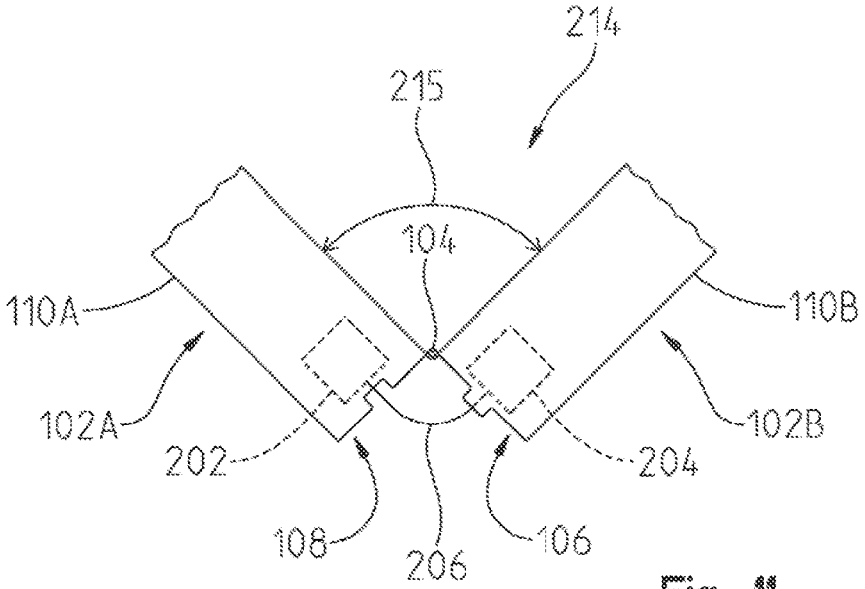
Figure 12:
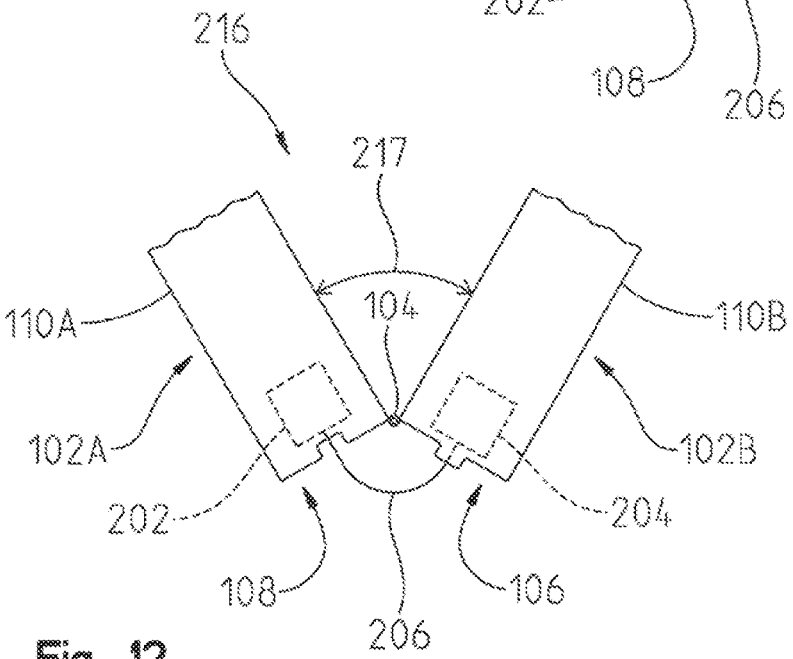
Figure 13:
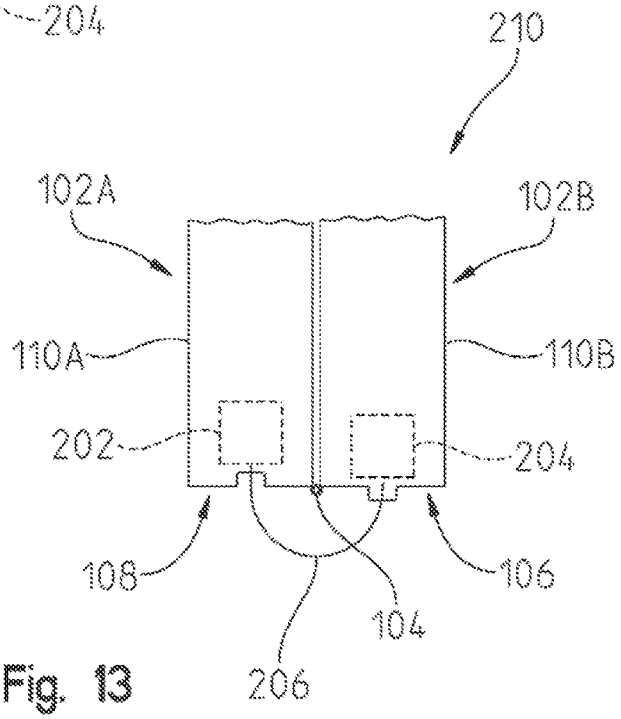
FIG. 13 illustrates the arrangement of FIG. 10 with the first movable wall panel and the second movable wall panel being in a stacked configuration wherein the first movable wall panel and the second movable wall panel are generally parallel and overlapping.
Figure 14:
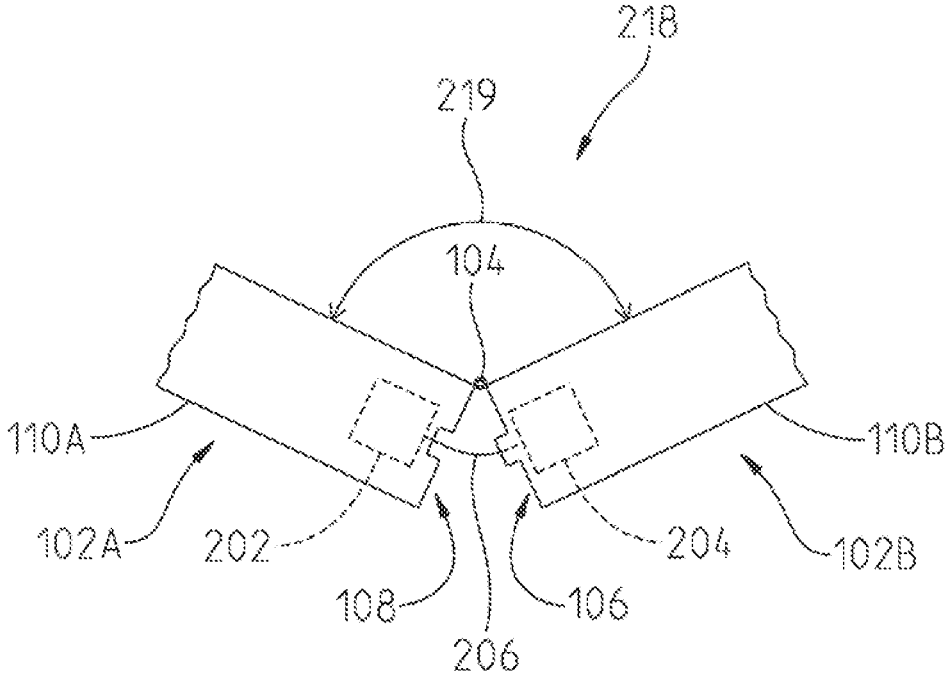

Referring to FIGS. 11-15, wall panel 102A and wall panel 102B are shown in a plurality of arrangements. As mentioned above, in the arrangement 210 shown in FIG. 13, panel face 110A of movable wall panel 102A and panel face 110B of movable wall panel 102B are generally parallel and overlapping and in the arrangement 212 shown in FIG. 15, panel face 110A of movable wall panel 102A and panel face 110B of movable wall panel 102B are generally parallel and non-overlapping. Referring to FIG. 11, an arrangement 214 is shown wherein panel face 110A of movable wall panel 102A and panel face 110B of movable wall panel 102B are angled relative to each other at a first angle 215. Referring to FIG. 12, an arrangement 216 is shown wherein panel face 110A of movable wall panel 102A and panel face 110B of movable wall panel 102B are angled relative to each other at a second angle 217, the second angle 217 being less than the first angle 215. Referring to FIG. 14, an arrangement 218 is shown wherein panel face 110A of movable wall panel 102A and panel face 110B of movable wall panel 102B are angled relative to each other at a third angle 219, the third angle 219 being greater than the first angle 215.

Figure 15:
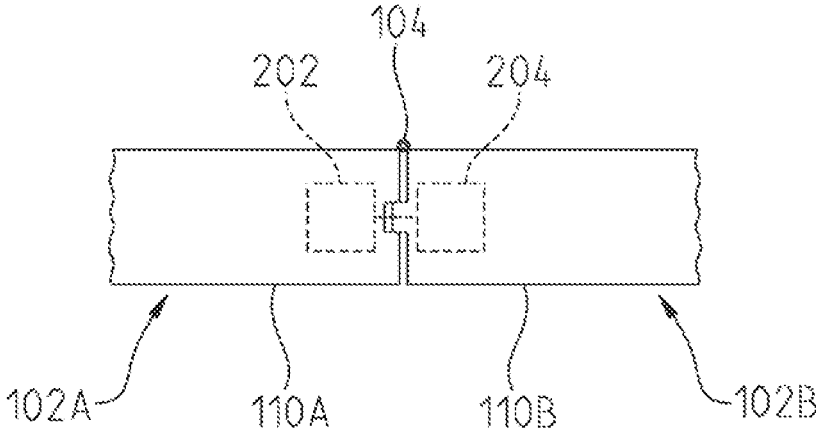
FIG. 15 illustrates the arrangement of FIG. 10 with the first movable wall panel and the second movable wall panel being in an extended configuration wherein the first movable wall panel and the second movable wall panel are generally parallel and non-overlapping.

In one embodiment, anti-float system 200 operates to bias movable wall panel 102A and movable wall panel 102B towards the arrangement of FIG. 13 when the angle formed by movable wall panel 102A and movable wall panel 102B is less than first angle 215 and to bias movable wall panel 102A and movable wall panel 102B towards the arrangement of FIG. 15 when the angle formed by movable wall panel 102A and movable wall panel 102B is more than first angle 215. As such, in arrangement 216 (see FIG. 12), anti-float system 200 would bias movable wall panel 102A and movable wall panel 102B towards the arrangement of FIG. 13 and in arrangement 218 (see FIG. 14) anti-float system 200 would bias movable wall panel 102A and movable wall panel 102B towards the arrangement of FIG. 15. In one example, first angle 215 has a value in the range of about 15 degrees to about 75 degrees. In another example, first angle 215 has a value in the range of about 25 degrees to about 65 degrees. In a further example, first angle 215 has a value of about 25 degrees.

Figure 21:
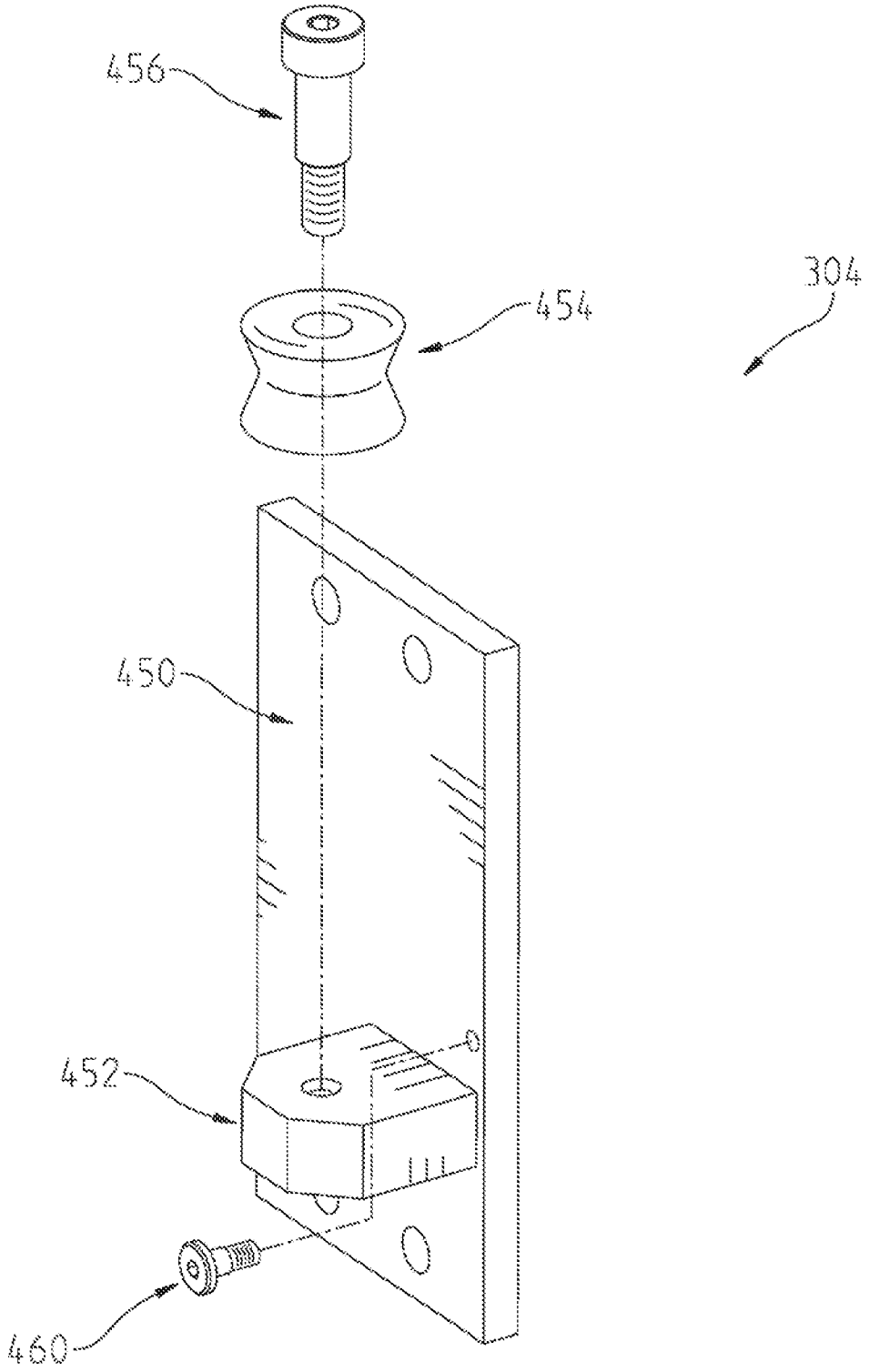
FIG. 21 illustrates an exploded, perspective view of the exemplary secondary biasing sub-assembly and connecting member of the anti-float system of FIG. 10.
Figure 22:
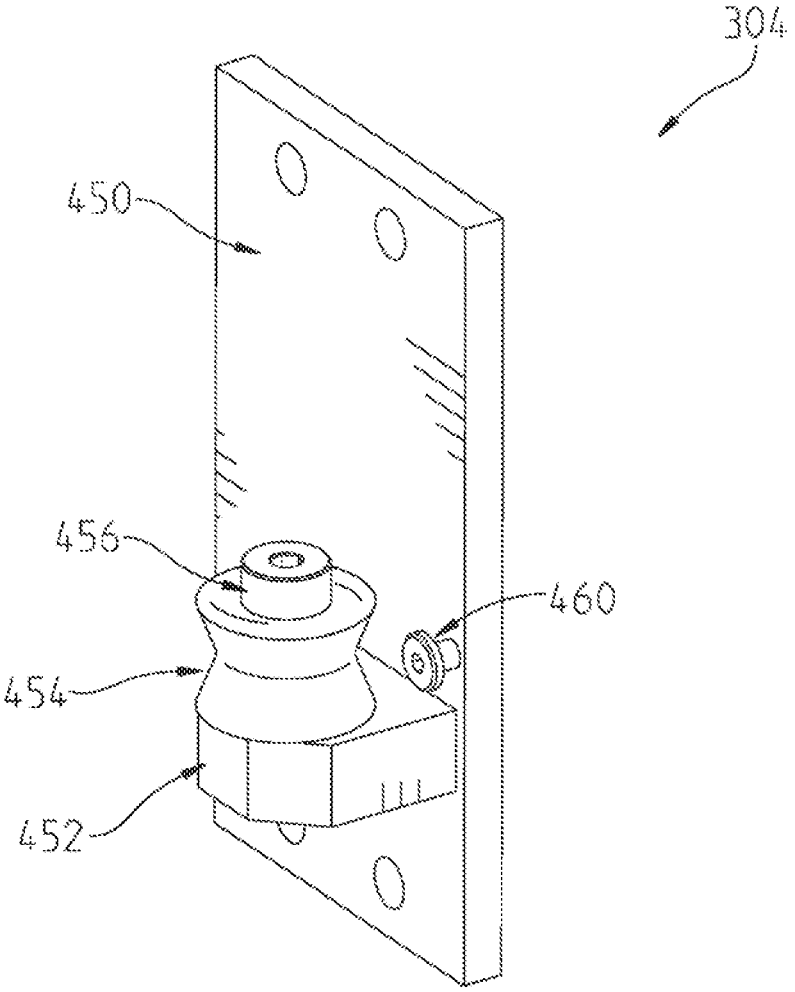
FIG. 22 illustrates an assembled, partial cutaway view of the exemplary secondary biasing sub-assembly and connecting member of the anti-float system of FIG. 21.
Figure 23:
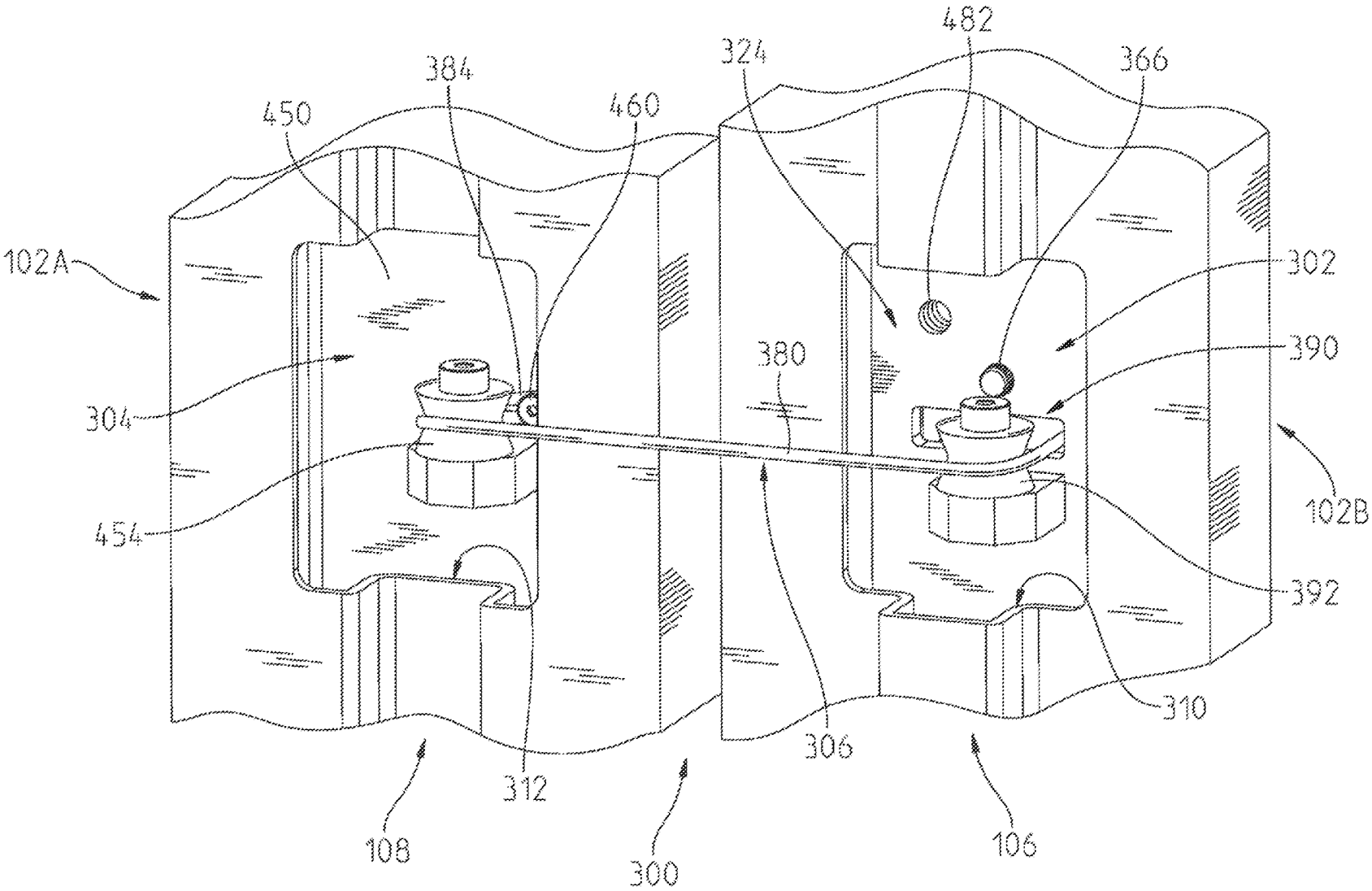
FIG. 23 illustrates an assembled, partial cutaway view of the exemplary primary biasing sub-assembly, the exemplary secondary biasing sub-assembly, and connecting member of the anti-float system coupled to the first movable wall panel and the second movable wall panel.

Referring to FIGS. 16-25, an exemplary anti-float system 300 is illustrated. Anti-float system 300 includes an exemplary primary biasing sub-assembly 302, an exemplary secondary biasing sub-assembly 304, and an exemplary link 306 connecting primary biasing sub-assembly 302 and secondary biasing sub-assembly 304. As illustrated in FIG. 23, primary biasing sub-assembly 302 is positioned within the interior of wall panel 102B and secondary biasing sub-assembly 304 is positioned within the interior of wall panel 102A. Link 306 extends through an opening 310 in first end 106 of wall panel 102B to connect with primary biasing sub-assembly 302 and extends through an opening 312 in second end 108 of wall panel 102A to connect with secondary biasing sub-assembly 304.

Figure 16:
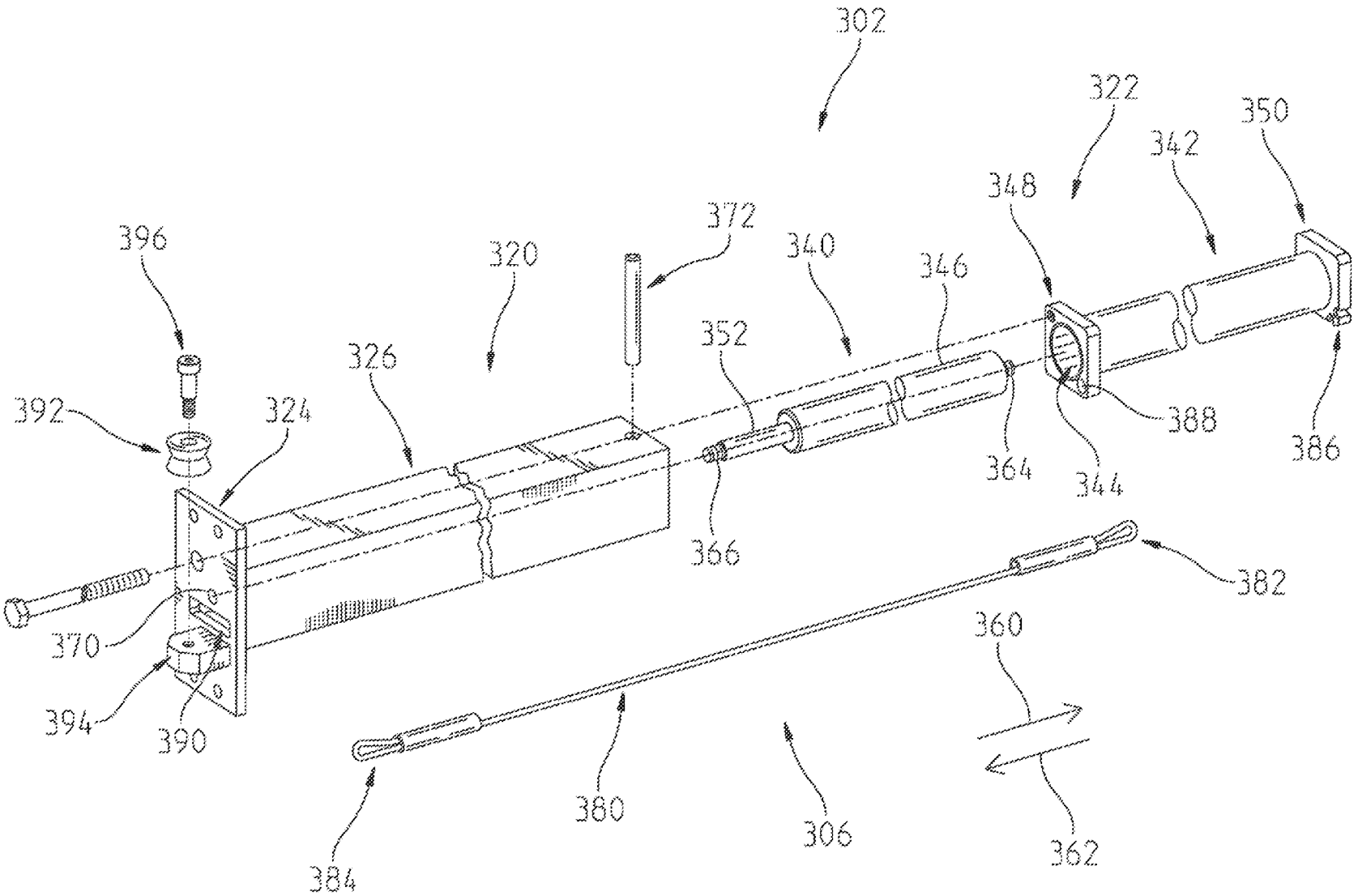
FIG. 16 illustrates an exploded, perspective view of the exemplary primary biasing sub-assembly and connecting member of the anti-float system of FIG. 10.

Referring to FIG. 16, an exploded view of primary biasing sub-assembly 302 is shown. Primary biasing sub-assembly 302 includes a housing 320 and a biasing member 322. Housing 320 includes a base 324 and an extension portion 326 having a hollow interior 328 (see FIG. 17). Base 324 includes a plurality of openings which receive couplers (not shown) to couple base 324 to frame 114 of wall panels 102.

Figure 17:
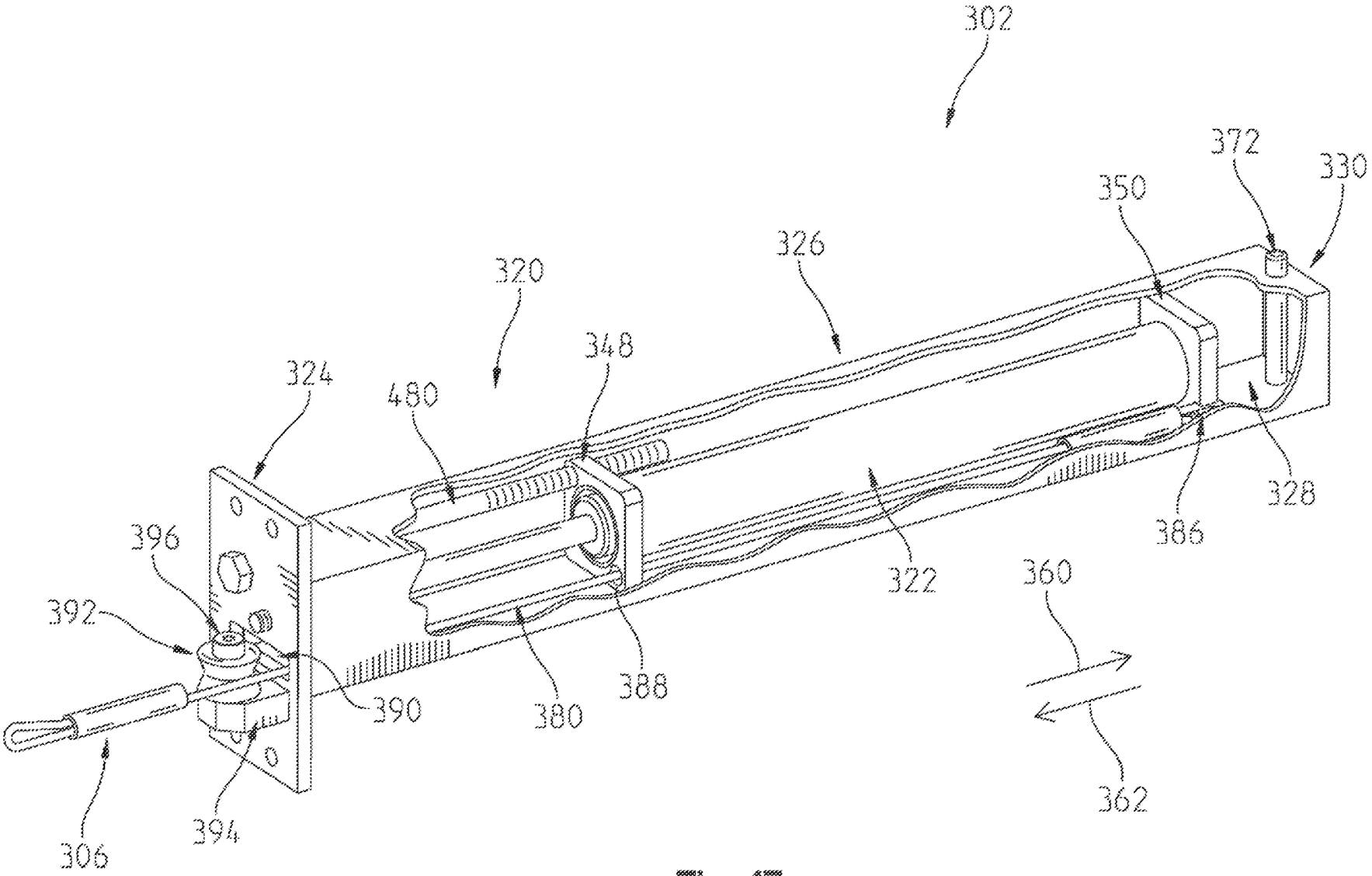
FIG. 17 illustrates an assembled, partial cutaway view of the exemplary primary biasing sub-assembly and connecting member of the anti-float system of FIG. 16 with a lock holding a biasing member.

Referring to FIG. 17, extension portion 326 includes an open end 330 through which biasing member 322 is inserted. Returning to FIG. 16, biasing member 322 includes a gas cylinder 340 and a slide tube 342. Slide tube 342 includes an open end 344 to receive the cylinder 346 of gas cylinder 340, a first flange 348, and a second flange 350. First flange 348 and second flange 350 are sized and shaped to generally match the contour of interior 328 of extension portion 326. Gas cylinder 340 includes cylinder 346 and a plunger 352. As is known in the art, plunger 352 can reciprocate within of cylinder 346. As plunger 352 is moved in direction 360 relative to cylinder 346, the gas inside of cylinder 346 is compressed, thereby increasing the potential energy of gas cylinder 340. As plunger 352 moves in direction 362 relative to cylinder 346, the gas inside of cylinder 346 is decompressed thereby decreasing the potential energy of gas cylinder 340. In one embodiment gas cylinder 340 is replaced with a spring.

Cylinder 346 includes a registration feature 364 which is received in an opening in second flange 350 of slide tube 342. Plunger 352 of gas cylinder 340 includes a threaded end 366 which is threaded into an opening 370 of base 324 of housing 320. In this manner a first end of biasing member 322, threaded end 366 of plunger 352, is secured to housing 320 and a second end of biasing member 322, second flange 350 of slide tube 342, is movable relative to housing 320 in direction 360 and direction 362. Biasing member 322 is retained within housing 320 by a retainer 372 coupled to housing 320 to block egress from open end 330 of housing 320.

Link 306 is coupled to biasing member 322. Referring to FIGS. 16 and 17, link 306, in the illustrated embodiment, is a flexible connector 380 having a first end formed in a loop 382 and a second end formed in a loop 384. Loop 382 is placed around anchor 386 formed on second flange 350 of slide tube 342. The middle portion of flexible connector 380 passes through an opening 388 in first flange 348 of slide tube 342 and through slot 390 in base 324 of housing 320. As mentioned herein, loop 384 of flexible connector 380 is coupled to secondary biasing sub-assembly 304. When assembled to secondary biasing sub-assembly 304, the middle portion of flexible connector 380 passes around a guide roller 392 held on a stand 394 coupled to base 324 by a shoulder bolt 396, as shown in FIG. 17.

In one embodiment, flexible connector 380 includes multiple strands which are twisted together. Exemplary materials for each strand include at least one of a metal, linen, hemp, silk, sinew, a polymer, or combinations thereof. In one example, each strand is made from an ultra high molecular weight polyethylene, such as the BCY dinoflight 97 bow string available from Three Rivers Archery Supply, Inc. located at P.O. Box 517 in Ashley, Ind. 46705. In one example, the flexible connector 380 includes at least 20 strands of ultra high molecular weight polyethylene twisted together. In another example, the flexible connector 380 includes 26 strands of ultra high molecular weight polyethylene twisted together.

Figure 19:
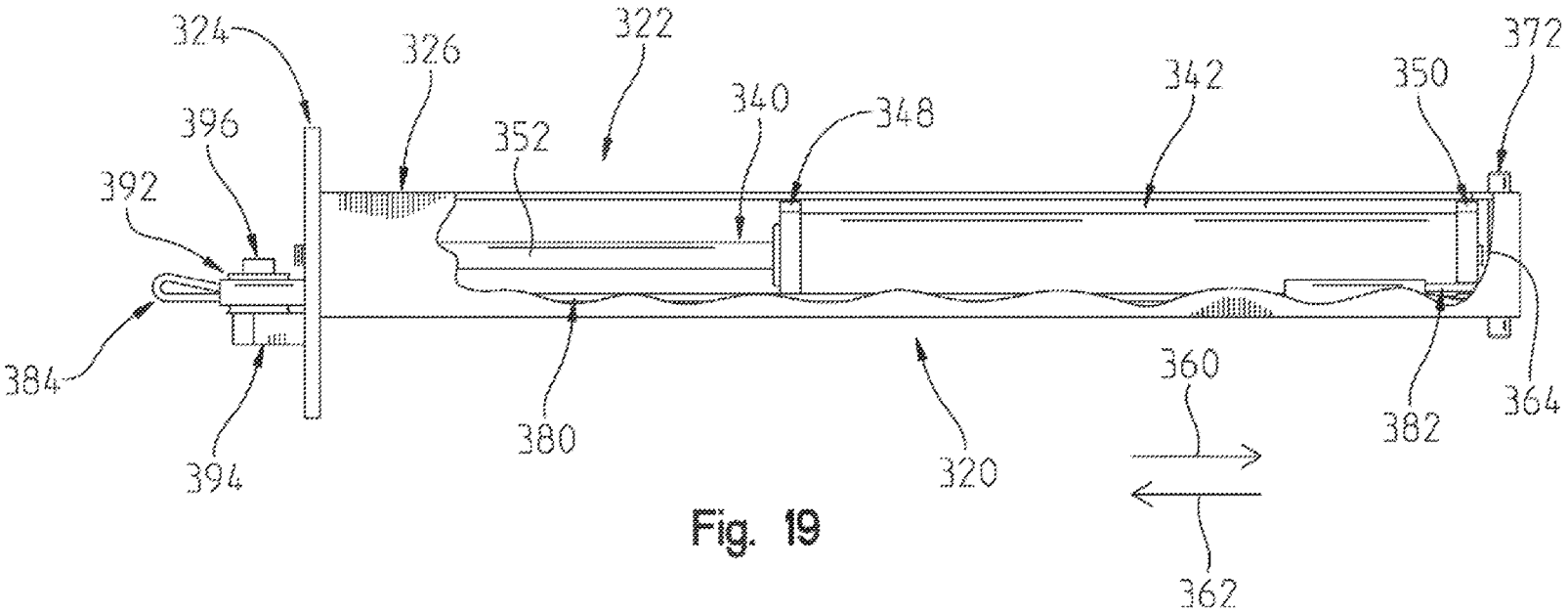
FIG. 19 illustrates an assembled, partial cutaway view of the exemplary primary biasing sub-assembly and connecting member of the anti-float system of FIG. 16 with the connecting member in a first position and the biasing member in a first position wherein an end of the biasing member is a first distance from a face plate of the housing of the exemplary primary biasing sub-assembly.
Figure 20:
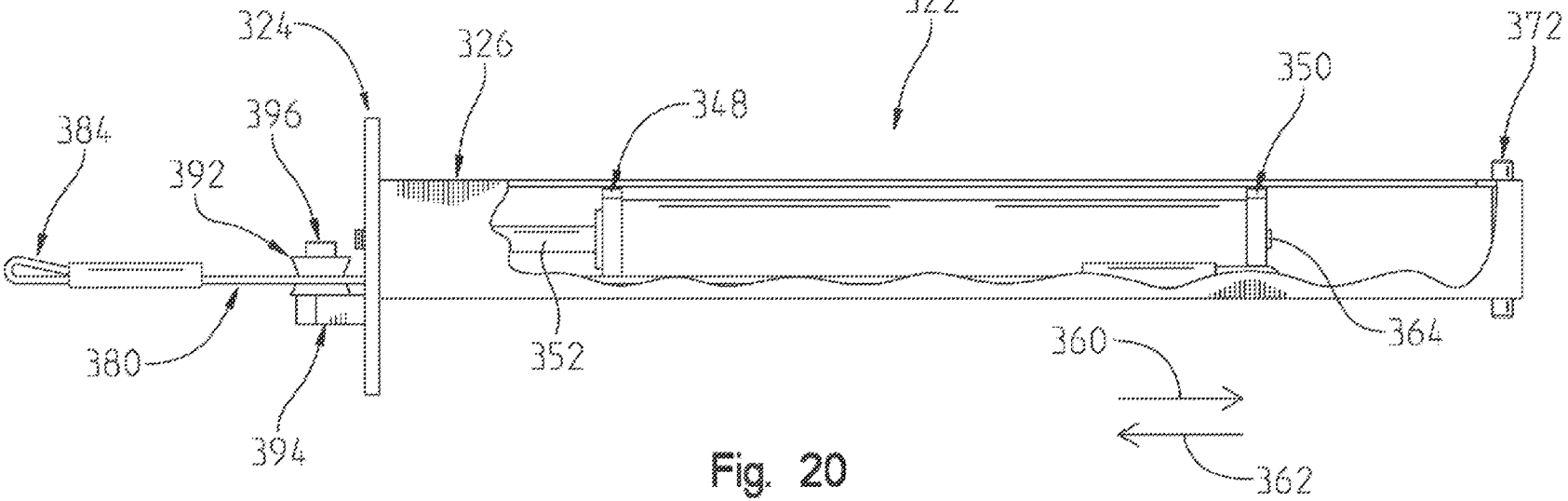
FIG. 20 illustrates an assembled, partial cutaway view of the exemplary primary biasing sub-assembly and connecting member of the anti-float system of FIG. 16 with the connecting member in a second position which is further extended out of the housing of the exemplary primary biasing sub-assembly and the biasing member in a second position wherein the end of the biasing member is a second distance from the face plate of the housing of the exemplary primary biasing sub-assembly, the second distance being less than the first distance of FIG. 19.

By pulling on flexible connector 380 in direction 362, second flange 350 of biasing member 322 is moved towards base 324 of housing 320, as shown in FIG. 20. The movement in direction 362 compresses gas cylinder 340. Gas cylinder 340 pushes on second flange 350 in direction 360 to move flexible connector 380 in direction 360, as shown in FIG. 19.

Referring to FIGS. 21 and 22, secondary biasing sub-assembly 304 includes a base 450 having a stand 452 extending therefrom. Base 450 includes a plurality of openings which receive couplers (not shown) to couple base 450 to frame 114 of wall panels 102. A guide roller 454 is held onto stand 452 by a shoulder bolt 456. Secondary biasing sub-assembly 304 further includes an anchor 460 which is secured to base 450. In the illustrated embodiment, anchor 460 is shoulder bolt threaded into an opening in base 450.

Referring to FIG. 23, loop 384 of flexible connector 380 is placed around anchor 460 of secondary biasing sub-assembly 304. Further, flexible connector 380 is placed around guide roller 392 of primary biasing sub-assembly 302 and guide roller 454 of secondary biasing sub-assembly 304. In one embodiment, flexible connector 380 is assembled to primary biasing sub-assembly 302 and secondary biasing sub-assembly 304 in the following manner. Referring to FIG. 17, flexible connector 380 is secured to anchor 386 of second flange 350 and is passed through opening 388 in first flange 348 and slot 390 of base 324. Flexible connector 380 is passed around guide roller 392 (as shown in FIG. 23), passed around guide roller 454 (as shown in FIG. 23), and secured to anchor 460 (as shown in FIG. 23). In order to pass flexible connector 380 around guide roller 392 and guide roller 454 and secured to anchor 460, gas cylinder 340 needs to be compressed to permit a sufficient length of flexible connector 380 to pass out of housing 320 through slot 390.

Figure 18:
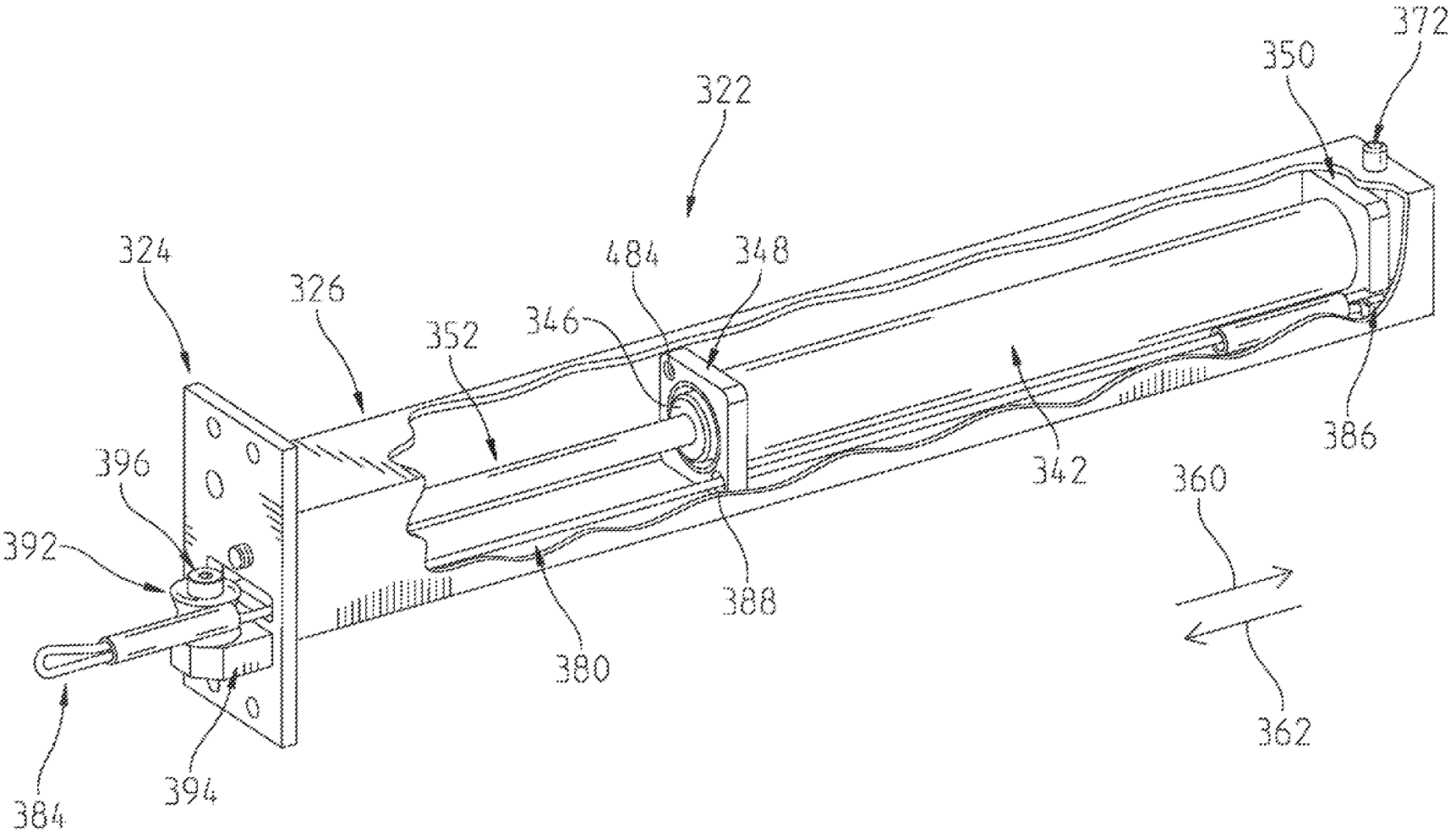
FIG. 18 illustrates an assembled, partial cutaway view of the exemplary primary biasing sub-assembly and connecting member of the anti-float system of FIG. 16 with the lock removed.

In the illustrated embodiment, anti-float system 300 further includes a lock 480 which holds gas cylinder 340 in a compressed state to assist in installing flexible connector 380 on primary biasing sub-assembly 302 and secondary biasing sub-assembly 304. In the illustrated embodiment, lock 480 is a bolt having a threaded shaft that passes through an opening 482 in base 324 (see FIG. 23) and which is threaded into an opening 484 (see FIG. 18) in first flange 348 of slide tube 342. FIG. 17 illustrates lock 480 positioned to hold gas cylinder 340 in a compressed state. FIG. 18 illustrates lock 480 removed which allows gas cylinder 340 to move in direction 362 towards an uncompressed state. To aid installation, lock 480 is placed in the position shown in FIG. 17 to provide ample length of flexible connector 380 to assemble flexible connector 380 to anchor 460 as shown in FIG. 23. Subsequently, lock 480 is removed which results in gas cylinder 340 moving in direction 362 and increasing the tension on flexible connector 380.

Figure 24:
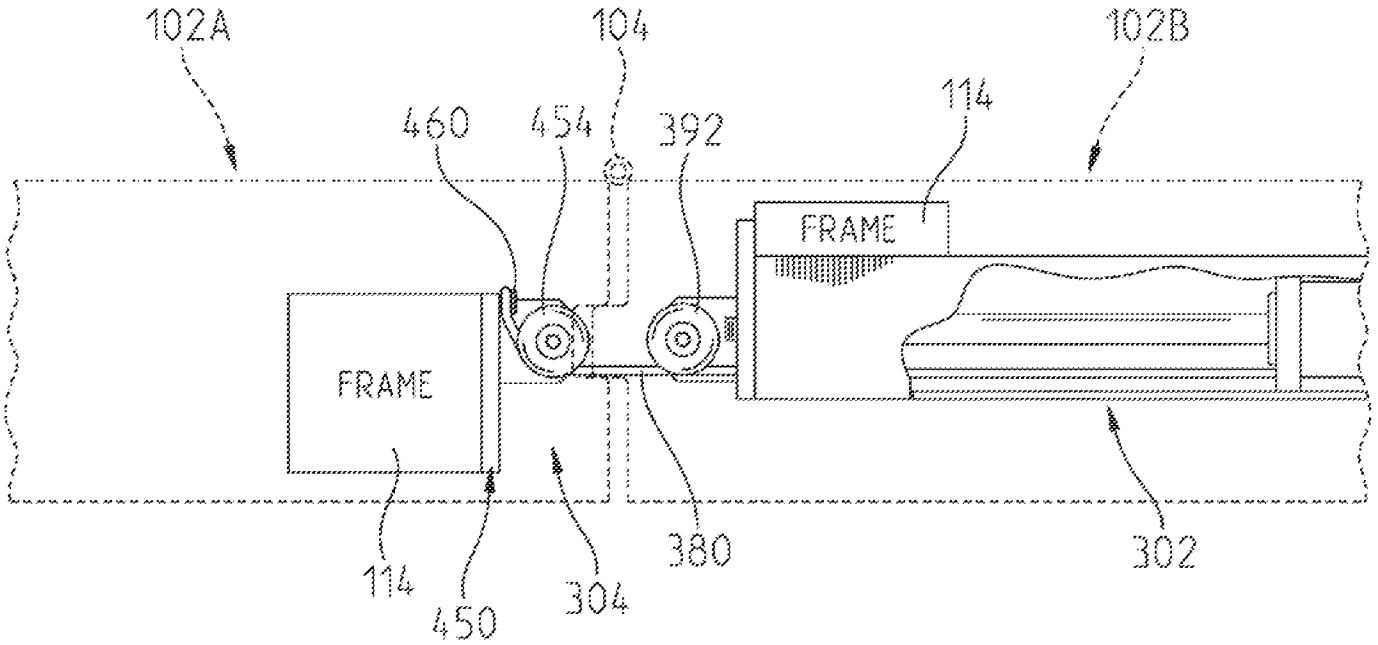
FIG. 24 illustrates the assembly of FIG. 23 in the extended configuration of FIG. 15 wherein the first movable wall panel and the second movable wall panel are generally parallel and non-overlapping.
Figure 25:
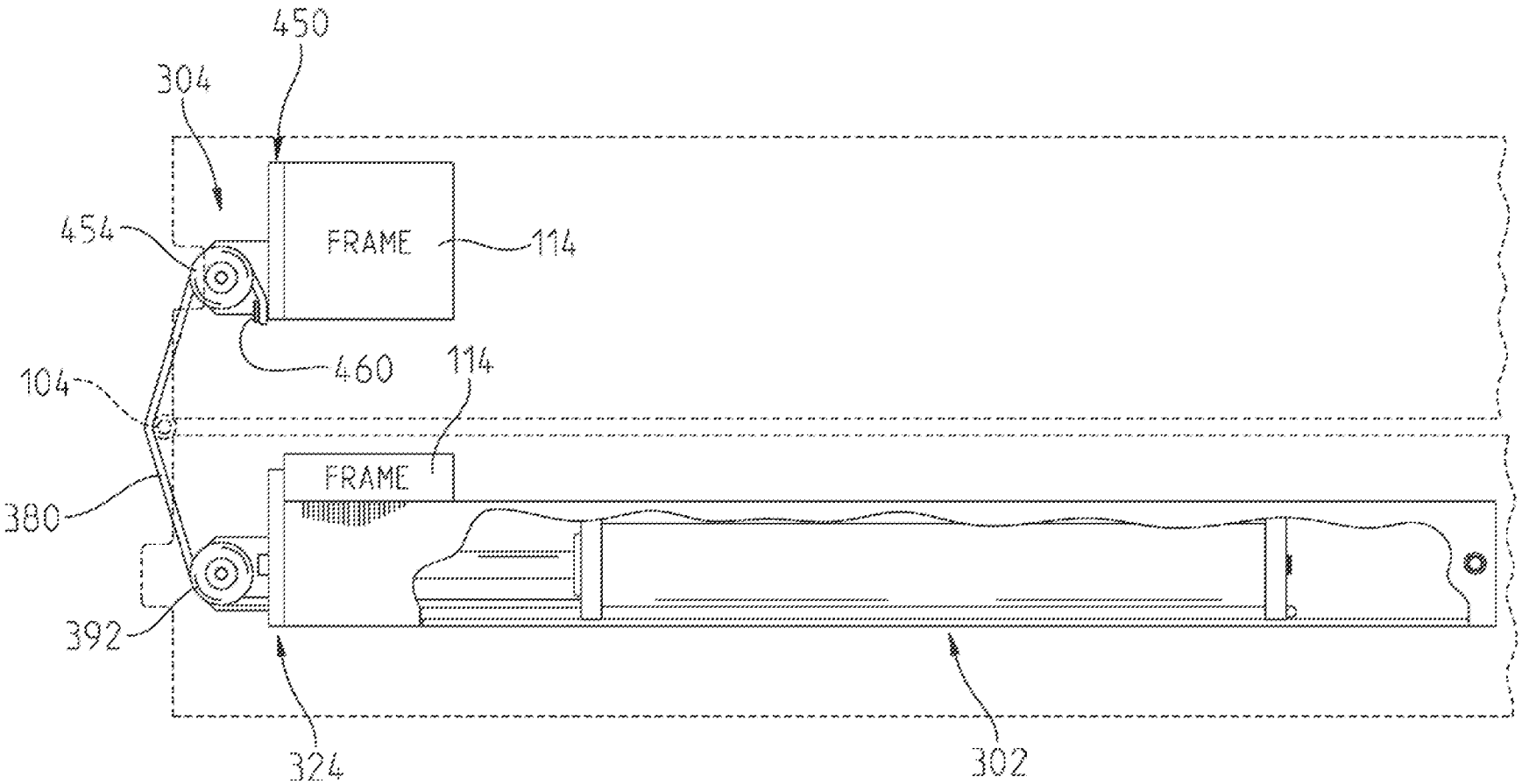
FIG. 25 illustrates the assembly of FIG. 23 in the stacked configuration of FIG. 13 wherein the first movable wall panel and the second movable wall panel are generally parallel and overlapping.

Referring to FIG. 24, wall panel 102A and wall panel 102B are shown in an extended configuration. Referring to FIG. 25, wall panel 102A and wall panel 102B are shown in a retracted configuration. Anti-float system 300 biases movable wall panel 102A and movable wall panel 102B towards either the arrangement of FIG. 24 or the arrangement of FIG. 0.25 depending on the angle between wall panel 102A and wall panel 102B about hinge 104. In one example, a first angle between wall panel 102A and wall panel 102B about hinge 104 is an inflection point such that for angle values greater than the first angle, wall panel 102A and wall panel 102B are biased towards the arrangement of FIG. 24 and for angle values less than the first angle, wall panel 102A and wall panel 102B are biased towards the arrangement of FIG. 25. In one example, first angle 215 has a value in the range of about 15 degrees to about 75 degrees. In another example, first angle 215 has a value in the range of about 25 degrees to about 65 degrees. In a further example, first angle 215 has a value of about 25 degrees. The placement of the guide rollers 392 and 454 relative to hinge 104 influences the value of the first angle.

While this disclosure has been described as having exemplary designs and embodiments, the present systems and methods may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains.

What is claimed is:

1. A movable wall panel system for suspension from an overhead track in an environment, the movable wall panel system comprising:

a first movable wall panel including a first end and a second end spaced-apart from the first end, a first panel face and a second panel face spaced apart from the first panel face of the first moveable wall panel;

a second movable wall panel rotatably coupled to the first movable wall, the second moveable wall panel including a first end and a second end;

at least one hinge coupled to the first movable wall panel proximate the second end of the first movable wall panel and coupled to the second movable wall panel proximate the first end of the second movable wall panel, the first movable wall panel being rotatably coupled to the second movable wall panel through the at least one hinge;

a top seal assembly coupled to a top portion of the first movable wall panel, the top seal assembly includes an upper portion that extends above a top edge of the first panel face of the first moveable wall panel and a lower portion that extends below the top edge of the first panel face of the first movable wall panel;

a bottom seal assembly coupled to a bottom portion of the first movable wall panel; and an anti-float device operatively coupled to the first moveable wall panel and to the second moveable wall panel, the anti-float device is positioned lower than the lower portion of the top seal assembly, the anti-float device including a link extending from the second end of the first moveable wall panel to the first end of the second moveable wall panel in both a stacked configuration wherein the first movable wall panel and the second movable wall panel are generally parallel and overlapping and an extended configuration wherein the first movable wall panel and the second movable wall panel are generally parallel and non-overlapping.

2. The movable wall panel system of claim 1, wherein the bottom seal assembly includes a lower portion that extends below a bottom edge of the first panel and an upper extent that extends above the bottom edge of the first panel, the anti-float device positioned higher than the upper extent of the bottom seal assembly.

3. The movable wall panel system of claim 1, wherein the anti-float device extends through an opening in the second end of the first movable wall panel towards the first end of the second moveable wall panel.

4. The movable wall panel system of claim 3, wherein the anti-float device further extends through an opening in the first end of the second movable wall panel.

5. The moveable wall panel system of claim 1, the anti-float device is operatively coupled to the first moveable wall panel and to the second moveable wall panel independent of the at least one hinge.

6. The moveable wall panel system of claim 1, wherein the anti-float device includes a biasing system having a primary biasing sub-assembly carried by the second moveable wall panel and a secondary biasing sub-assembly carried by the first moveable wall panel.

7. The moveable wall panel system of claim 6, wherein the primary biasing sub-assembly is positioned between the first panel face of the second moveable wall panel and the second panel face of the second moveable wall panel.

8. The moveable wall panel system of claim 7, wherein the link connects the primary biasing sub-assembly to the secondary biasing sub-assembly.

9. The moveable wall panel system of claim 8, wherein the link is a flexible connector connecting the primary biasing sub-assembly to the secondary biasing sub-assembly, the flexible connector received through an opening in the second end of the first movable wall panel and an opening in the first end of the second movable wall panel.

10. The moveable wall panel system of claim 9, wherein the primary biasing sub-assembly includes a biasing member operatively coupled to the flexible connector to retract the flexible connector within the second moveable wall panel.

11. The moveable wall panel system of claim 10, wherein the primary biasing sub-assembly further includes a lock which prevents the biasing member from applying a tension to flexible connector.

12. The moveable wall panel system of claim 11, wherein the biasing member is a gas spring.

13. The moveable wall panel system of claim 11, wherein the lock is actuatable from an exterior of the second moveable wall panel to configure the biasing member to apply tension to the flexible connector.

14. The moveable wall panel system of claim 13, wherein the second moveable wall panel includes a first panel face and a second panel face and the first moveable wall panel and the second moveable wall panel are biased by the anti-float device towards an arrangement wherein the first panel face of the first moveable wall panel is parallel to the first panel face of the second moveable wall panel when the first moveable wall panel is angled relative to the second moveable all panel about the hinge by more than a first angle.

15. The moveable wall panel system of claim 14, wherein the first angle has a value in the range of about 15 degrees to about 75 degrees.

16. The moveable wall panel system of claim 14, wherein the first angle has a value in the range of about 25 degrees to about 65 degrees.

17. The moveable wall panel system of claim 14, wherein the first angle has a value of about 25 degrees.

18. The moveable wall panel system of claim 1, wherein the second moveable wall panel includes a first panel face and a second panel face and the first moveable wall panel and the second moveable wall panel are biased by the anti-float device towards an arrangement wherein the first panel face of the first moveable wall panel is parallel to the first panel face of the second moveable wall panel when the first moveable wall panel is angled relative to the second moveable wall panel about the hinge by more than a first angle.

19. The moveable wall panel system of claim 18, wherein the first angle has a value in the range of about 15 degrees to about 75 degrees.

20. The moveable wall panel system of claim 18, wherein the first angle has a value of about 25 degrees.

21. A movable wall panel system for suspension from an overhead track in an environment, the movable wall panel system comprising:

a first movable wall panel including a first end and a second end spaced-apart from the first end, a first panel face and a second panel face spaced apart from the first panel face of the first moveable wall panel;

a second movable wall panel rotatably coupled to the first movable wall, the second moveable wall panel including a first end and a second end;

at least one hinge coupled to the first movable wall panel proximate the second end of the first movable wall panel and coupled to the second movable wall panel proximate the first end of the second movable wall panel, the first movable wall panel being rotatably coupled to the second movable wall panel through the at least one hinge;

a top seal assembly coupled to a top portion of the first movable wall panel, the top seal assembly includes an upper portion that extends above a top edge of the first panel face of the first moveable wall panel and a lower portion that extends below the top edge of the first panel face of the first movable wall panel;

a bottom seal assembly coupled to a bottom portion of the first movable wall panel; and an anti-float device operatively coupled to the first moveable wall panel and to the second moveable wall panel, the anti-float device is positioned lower than the lower portion of the top seal assembly;

wherein the second moveable wall panel includes a first panel face and a second panel face and the first moveable wall panel and the second moveable wall panel are biased by the anti-float device towards an arrangement wherein the first panel face of the first moveable wall panel is parallel to the first panel face of the second moveable wall panel when the first moveable wall panel is angled relative to the second moveable wall panel about the hinge by more than a first angle.

22. A movable wall panel system for suspension from an overhead track in an environment, the movable wall panel system comprising:

a first movable wall panel including a first end and a second end spaced-apart from the first end, a first panel face and a second panel face spaced apart from the first panel face of the first moveable wall panel;

a second movable wall panel rotatably coupled to the first movable wall, the second moveable wall panel including a first end and a second end;

at least one hinge coupled to the first movable wall panel proximate the second end of the first movable wall panel and coupled to the second movable wall panel proximate the first end of the second movable wall panel, the first movable wall panel being rotatably coupled to the second movable wall panel through the at least one hinge;

a top seal assembly coupled to a top portion of the first movable wall panel, the top seal assembly includes an upper portion that extends above a top edge of the first panel face of the first moveable wall panel and a lower portion that extends below the top edge of the first panel face of the first movable wall panel;

a bottom seal assembly coupled to a bottom portion of the first movable wall panel;

an anti-float device operatively coupled to the first moveable wall panel and to the second moveable wall panel, the anti-float device is positioned lower than the lower portion of the top seal assembly;

wherein the anti-float device includes a biasing system having a primary biasing sub-assembly carried by the second moveable wall panel, and a secondary biasing sub-assembly carried by the first moveable wall panel, the primary biasing sub-assembly being positioned between the first panel face of the second moveable wall panel and the second panel face of the second moveable wall panel; and a link connecting the primary biasing sub-assembly to the secondary biasing sub-assembly, wherein the link is a flexible connector connecting the primary biasing sub-assembly to the secondary biasing sub-assembly, the flexible connector received through an opening in the second end of the first movable wall panel and an opening in the first end of the second movable wall panel;

wherein the primary biasing sub-assembly includes a biasing member operatively coupled to the flexible connector to retract the flexible connector within the second moveable wall panel.

* * * * *